US008568063B2

(12) United States Patent
Brinkmann et al.

(10) Patent No.: US 8,568,063 B2
(45) Date of Patent: Oct. 29, 2013

(54) MOORING SYSTEM FOR FLOATING ARCTIC VESSEL

(75) Inventors: Carl R. Brinkmann, Bellaire, TX (US); Theodore Kokkinis, Houston, TX (US); Adel H. Younan, Sugar Land, TX (US); Finbarr J. Bruen, The Woodlands, TX (US); Patricia Bruen, legal representative, The Woodlands, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 13/255,836

(22) PCT Filed: Feb. 2, 2010

(86) PCT No.: PCT/US2010/022916
§ 371 (c)(1),
(2), (4) Date: Sep. 9, 2011

(87) PCT Pub. No.: WO2010/126629
PCT Pub. Date: Nov. 4, 2010

(65) Prior Publication Data

US 2012/0266801 A1 Oct. 25, 2012

Related U.S. Application Data

(60) Provisional application No. 61/174,284, filed on Apr. 30, 2009.

(51) Int. Cl.
*B63B 21/50* (2006.01)

(52) U.S. Cl.
USPC ..... 405/224; 405/224.1; 114/230.2

(58) Field of Classification Search
USPC ..... 405/195.1, 223.1, 224, 224.1, 224.2, 405/224.3, 224.4, 226, 227, 228; 114/264, 114/265, 266, 230.1, 230.2
See application file for complete search history.

(56) References Cited

U.S. PATENT DOCUMENTS 3,669,052 A 6/1972 Schirtzinger
3,672,175 A 6/1972 Mason (Continued)

FOREIGN PATENT DOCUMENTS

GB 2 170 250 A 7/1986
WO WO 2007/089152 A1 8/2007
WO WO 2008140654 A1 * 11/2008

OTHER PUBLICATIONS

English translation of FR 2 693 525, Jan. 14, 1994, 9 pages.

(Continued)

*Primary Examiner* — Frederick L Lagman
(74) *Attorney, Agent, or Firm* — ExxonMobil Upstream Research Company-Law Department

(57) ABSTRACT

A mooring system for a floating vessel such as a drilling unit is provided. The floating vessel has a platform for providing drilling, production or other operations in a marine environment, and a tower for providing ballast and stability below a water line in the marine environment. The mooring system generally includes a plurality of anchors disposed radially around the tower along a seabed, and a plurality of mooring lines. Each mooring line has a first end operatively connected to the tower, and a second end operatively connected to a respective anchor. Each mooring line further comprises at least two substantially rigid links joined together using linkages. Each joint is at least five meters in length. The mooring system is capable of maintaining station-keeping for the vessel greater than about 100 Mega-Newtons such that operations may be conducted when the marine environment is substantially iced over.

41 Claims, 20 Drawing Sheets

(56) References Cited

U.S. PATENT DOCUMENTS

| | | | | |
|---|---|---|---|---|
| 3,678,873 | A | | 7/1972 | Bennett |
| 3,693,360 | A | | 9/1972 | Holder |
| 3,693,729 | A | | 9/1972 | Blurton et al. |
| 3,696,624 | A | | 10/1972 | Bennett |
| 3,739,736 | A | | 6/1973 | Carreau et al. |
| 3,749,162 | A | | 7/1973 | Anders |
| 3,759,046 | A | | 9/1973 | Anders |
| 3,766,874 | A | | 10/1973 | Helm et al. |
| 3,793,840 | A | | 2/1974 | Mott et al. |
| 3,837,311 | A | | 9/1974 | Lea, Jr. |
| 3,872,814 | A | | 3/1975 | Rodriguez |
| 3,965,835 | A | | 6/1976 | Bennett |
| 4,022,142 | A | | 5/1977 | Stegall |
| 4,048,943 | A | | 9/1977 | Gerwick, Jr. |
| 4,073,144 | A | | 2/1978 | Lea |
| 4,075,964 | A | | 2/1978 | Sjogren |
| 4,117,794 | A | | 10/1978 | Sjogren |
| 4,170,187 | A | | 10/1979 | Schirtzinger |
| 4,295,758 | A | | 10/1981 | Yashima |
| 4,323,322 | A | | 4/1982 | O'Rourke et al. |
| 4,335,980 | A | | 6/1982 | DePriester |
| 4,382,419 | A | | 5/1983 | van Drimmelen et al. |
| 4,433,941 | A | | 2/1984 | Gerwick, Jr. et al. |
| 4,434,741 | A | | 3/1984 | Wright et al. |
| 4,455,958 | A | | 6/1984 | O'Rourke et al. |
| 4,457,250 | A | | 7/1984 | Oshima et al. |
| 4,471,709 | A | | 9/1984 | Chun |
| 4,477,207 | A | | 10/1984 | Johnson |
| 4,509,448 | A | | 4/1985 | Pease et al. |
| 4,519,728 | A | | 5/1985 | Oshima et al. |
| 4,604,961 | A | | 8/1986 | Ortloff et al. |
| 4,695,201 | A | | 9/1987 | Beskow et al. |
| 4,755,082 | A | | 7/1988 | Beskow et al. |
| 4,797,035 | A | | 1/1989 | Hunter |
| 5,011,106 | A | | 4/1991 | Cody |
| 5,218,917 | A | | 6/1993 | Harjula et al. |
| 5,305,703 | A | | 4/1994 | Korsgaard |
| 5,791,819 | A | * | 8/1998 | Christiansen ..... 405/224 |
| 6,027,286 | A | * | 2/2000 | Pollack ..... 405/223.1 |
| 6,113,314 | A | | 9/2000 | Campbell |
| 6,854,933 | B2 | * | 2/2005 | Horton, III ..... 405/223.1 |
| 6,932,542 | B2 | * | 8/2005 | Chianis et al. ..... 405/223.1 |
| 2002/0197116 | A1 | * | 12/2002 | Zou et al. ..... 405/223.1 |
| 2010/0126401 | A1 | | 5/2010 | Kokkinis |

OTHER PUBLICATIONS

English translation of abstract of JP 60179386 A2, Sep. 13, 1985, 1 page.

* cited by examiner

MOORING SYSTEM FOR FLOATING ARCTIC VESSEL

CROSS REFERENCE TO RELATED APPLICATIONS

This application is the National Stage of International Application No. PCT/US2010/022916, filed Feb. 2, 2010, which claims the benefit of U.S. Provisional Application No. 61/174,284, filed Apr. 30, 2009.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present invention relates to the field of offshore drilling technology. More specifically, the present invention relates to a floating marine drilling unit that employs a riser and mooring system suitable for use in icy arctic waters.

DISCUSSION OF TECHNOLOGY

As the world's demand for fossil fuels increases, energy companies find themselves pursuing hydrocarbon resources located in more remote and hostile areas of the world, both onshore and offshore. Such areas include Arctic regions where ambient air temperatures reach well below the freezing point of water. Specific onshore examples include Canada, Greenland and northern Alaska.

One of the major problems encountered in offshore arctic regions is the continuous formation of sheets of ice on the water surface. Ice masses formed off of coastlines over water depths greater than 20 or 25 meters are dynamic in that they are almost constantly moving. The ice masses, or ice sheets, move in response to such environmental factors as wind, waves, and currents. Ice sheets may move laterally through the water at rates as high as about a meter/second. Such dynamic masses of ice can exert enormous forces on structural objects in their path. Therefore, offshore structures operating in arctic seas must be able to withstand or overcome the forces created by moving ice.

Another danger encountered in arctic waters is pressure ridges of ice. These are large mounds of ice which usually form within ice sheets and which may consist of overlapping layers of sheet ice and re-frozen rubble caused by the collision of ice sheets. Pressure ridges can be up to 30 meters thick or more and can, therefore, exert proportionately greater forces than ordinary sheet ice.

Bottom supported stationary structures are particularly vulnerable in offshore arctic regions, especially in areas of deep water. The major force of an ice sheet or pressure ridge is directed near the surface of the water. If an offshore structure comprises a drilling platform or deck supported by a long, comparatively slender column which extends well below the surface, the bending moments caused by the laterally moving ice may well be sufficient to topple the platform.

U.S. Pat. No. 4,048,943, issued in 1977 to Gerwick, proposed a drilling unit having an inverted, conically-shaped structure floating generally above the water line. The inverted structure includes a top surface or deck for supporting drilling equipment and activities. The drilling unit also includes a large, cylindrical caisson floating below the inverted conically-shaped structure. The caisson then includes a radially tapered upper portion, preferably conically shaped, connected to the inverted, conically-shaped structure below the water line. Mooring lines are attached to the caisson and then anchored to the sea floor to secure the drilling unit's position in the water.

The drilling unit of Gerwick includes means for vertically reciprocating the caisson. In this way, the upper portion of the caisson can obliquely contact ice sheets and other ice masses with sufficient dynamic force to pierce and break the ice. The moving ice strikes the slanted wall of the cone-shaped structure, and is uplifted. The uplift of the ice not only tends to break the ice, but also substantially alleviates the horizontal crushing force of the ice on the structure.

Other drilling structures having inverted, conical-shaped hulls are disclosed in U.S. Pat. No. 3,766,874 issued to Helm, et al. and U.S. Pat. No. 4,434,741 issued to Wright, et al. Such structures employ hulls that are generally frusto-conical in shape to fracture ice impinging on the hull. The hulls are moored to the sea bottom using traditional chains or wire ropes.

In traditional offshore operations, the use of chains, wire ropes or synthetic ropes for mooring lines is desirable. These mooring lines offer flexibility to the floating structure, allowing the structure to move in response to waves, wind, and currents. At the same time, such traditional mooring lines may not provide sufficient strength to withstand the high shear forces presented by moving ice sheets. Current mooring systems on floating vessels have limited capability to resist ice loads and are generally limited to open water and warm-weather seasonal drilling or production operations.

Full development of offshore oil and gas fields requires operations from a given location; for example, the drilling of multiple wells from a given location. This is true even in arctic locations where ice sheets cover the water much of the year. It is desirable to maintain year-round operations to avoid the expense of seasonal relocation and the complexities of multi-year re-entry in partially drilled wells.

Therefore, a need exists for an improved mooring system that is capable of maintaining an offshore floating unit on a given location in an arctic environment.

SUMMARY OF THE INVENTION

A mooring system for a floating arctic vessel is provided. The vessel may be, for example, a floating drilling unit. The vessel may alternatively be an axi-symmetric research vessel or other vessel used for offshore drilling, production, exploration, remediation, or research operations.

The vessel has a platform for providing operations in a marine environment. The vessel further has a tower for providing ballast and stability below a water line in the marine environment. The platform may be supported by a hull having a frusto-conical shape. In this instance, the vessel further comprises a neck connecting the platform structure to the tower.

The mooring system generally includes a plurality of anchors disposed radially around the tower along a seabed. The anchors may be weighted blocks held on the seabed by gravity. Alternatively, the anchors may each comprise, for example, a frame structure with a plurality of pile-driven pillars or suction pillars secured to the earth proximate the seabed.

The mooring system also has a plurality of mooring lines. Each mooring line has a first end operatively connected to the tower, and a second end operatively connected to a respective anchor. Each mooring line further comprises at least two substantially rigid links joined together using linkages or pivoting connections. Selected links within each of the plurality of mooring lines may comprise material that increases buoyancy.

In one aspect, each link is at least five meters in length. Each link may comprise, for example, a plurality of elongated metallic members disposed parallel to one another. In one arrangement, the first end of each of the plurality of mooring lines is connected to the tower proximate an upper end of the tower. Preferably, each of the first ends is selectively connectable to the tower at two or more different depths along the upper end of the tower so as to adjust the draft of the floating drilling unit within the marine environment. In addition, each of the plurality of anchors may comprise a plurality of connection points for selectively connecting each respective mooring line along a corresponding anchor. In this way, the distance of the tower from the connection point may be adjusted.

The mooring system has the capacity to support offshore operations year-round, even in winter months when the marine environment is substantially iced over. Preferably, the mooring system has the capacity to maintain station-keeping for the vessel in the presence of ice forces greater than about 100 Mega-Newtons.

The ice forces typically represent moving ice sheets. The forces created by the ice sheets have a horizontal component. In one aspect, each mooring line is capable of withstanding at least about 500 Mega-Newtons of horizontal force.

In one embodiment, the mooring system further comprises a plurality of secondary mooring lines. Each line has a first end connected to the tower proximate a bottom end of the tower, and a second end connected to a respective anchor. Each of the secondary mooring lines may be fabricated from chains, wire ropes, synthetic ropes or pipes.

A method for deploying a mooring system for a floating structure is also provided herein. In one aspect, the method includes:

(A) placing a positioning template on a seabed at an offshore work site;

(B) providing a setting line, the setting line having a first end, a second end, and a plurality of substantially rigid links joined together using linkages, each link comprising at least one elongated, metallic member;

(C) connecting the first end of the setting line to the positioning template;

(D) connecting the second end of the setting line to an anchor;

(E) securing the anchor along the seabed according to the first length;

(F) disconnecting the first end of the setting line from the positioning template and the second end of the setting line from the anchor;

(G) repeating steps (A) through (F) for successive anchors such that a plurality of anchors is placed around the positioning template;

(H) providing a permanent mooring line, the mooring line having a first end, a second end, and a plurality of substantially rigid links joined together using linkages;

(I) operatively connecting the second end of the mooring line to an anchor;

(J) operatively connecting, a first end of the mooring line to the floating structure; and (K) repeating steps (H) through (J) for each of the successive anchors.

The floating structure is preferably a floating drilling unit. In this instance, the drilling unit may include a platform for providing drilling production operations in a marine environment, and a tower adapted to provide ballast and stability below a water line in the marine environment. The positioning template is placed below the intended location of the tower at the drill-site. Preferably, the first end of each of the respective permanent mooring lines is operatively connected to a top portion of the tower.

As with the mooring lines in the mooring system described above, each link in the permanent mooring lines comprises a plurality of elongated members disposed parallel to one another. The members may be metallic, ceramic, or other material having high tensile strength. The lings are joined together using a pivoting connector. In one aspect, each of the plurality of elongated members comprises either two or more eyebars or two or more substantially hollow tubular members. Each permanent mooring line is preferably capable of withstanding at least about 100 Mega-Newtons of force from a moving ice sheet.

A method for relocating a floating structure is also provided herein. The floating structure comprises a platform for providing operations in a marine environment, and a tower for providing ballast and stability below a water line in the marine environment. In one aspect, the method includes disconnecting the tower from the platform. The tower is then lowered within the marine environment to a depth below the depth of an oncoming ice sheet.

In accordance with the method, the floating structure is moved to a new location in the marine environment. In this way the floating structure is able to avoid impact from the ice sheet.

In this method, the floating structure is originally stationed in the arctic marine environment by means of a mooring system. The mooring system has a plurality of mooring lines, each mooring line having a first end and a second end. Each mooring line further has at least two substantially rigid links joined together using pivoting connections. The pivoting connections permit the mooring lines to kinematically collapse as the tower is lowered into the marine environment. The mooring system also includes a plurality of anchors placed along the seabed. Each anchor secures a respective mooring line at the second end of the mooring line.

In one aspect, selected links within each of the plurality of mooring lines receives a material that increases buoyancy. In this way the mooring lines more easily kinematically collapse to accommodate the reduced distance from the respective anchors to the tower as the tower is lowered to the seabed.

As with the mooring lines in the mooring system described above, each link in the permanent mooring lines comprises a plurality of elongated members disposed parallel to one another. The members may be metallic, ceramic, or other material having high tensile strength. The links are joined together using a pivoting connector. In one aspect, each of the plurality of elongated members comprises either two or more eyebars or two or more substantially hollow tubular members. Each permanent mooring line is preferably capable of withstanding at least about 100 Mega-Newtons of force from a moving ice sheet.

BRIEF DESCRIPTION OF THE DRAWINGS

So that the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

As used herein, the term "hydrocarbon" refers to an organic compound that includes primarily, if not exclusively, the elements hydrogen and carbon. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "fluid" refers to gases, liquids, and combinations of gases and liquids, as well as to combinations of gases and solids, and combinations of liquids and solids.

As used herein, the term "subsurface" refers to geologic strata occurring below the earth's surface.

The term "eyebar" refers to any elongated object that has a connection means at opposing ends. A non-limiting example is a "dog bone" that has through-openings at each end for receiving a u-joint or a pin or other pivoting connector.

The term "seabed" refers to the floor of a marine body. The marine body may be an ocean or sea or any other body of water that experiences waves, winds, and/or currents.

The term "arctic" refers to any oceanographic region wherein ice features may form or traverse through. The term "arctic," as used herein, is broad enough to include geographic regions in proximity to both the North Pole and the South Pole.

The term "marine environment" refers to any offshore location. The offshore location may be in shallow waters or in deep waters. The marine environment may be an ocean body, a bay, a large lake, an estuary, a sea, or a channel.

The term "ice sheet" means a floating and moving mass of ice, floe ice, or ice field. The term also encompasses pressure ridges of ice within ice sheets.

The term "platform" means a deck on which offshore operations such as drilling operations take place. The term may also encompass any connected supporting floating structure such as a conical hull.

DESCRIPTION OF SPECIFIC EMBODIMENTS

Figure 1:
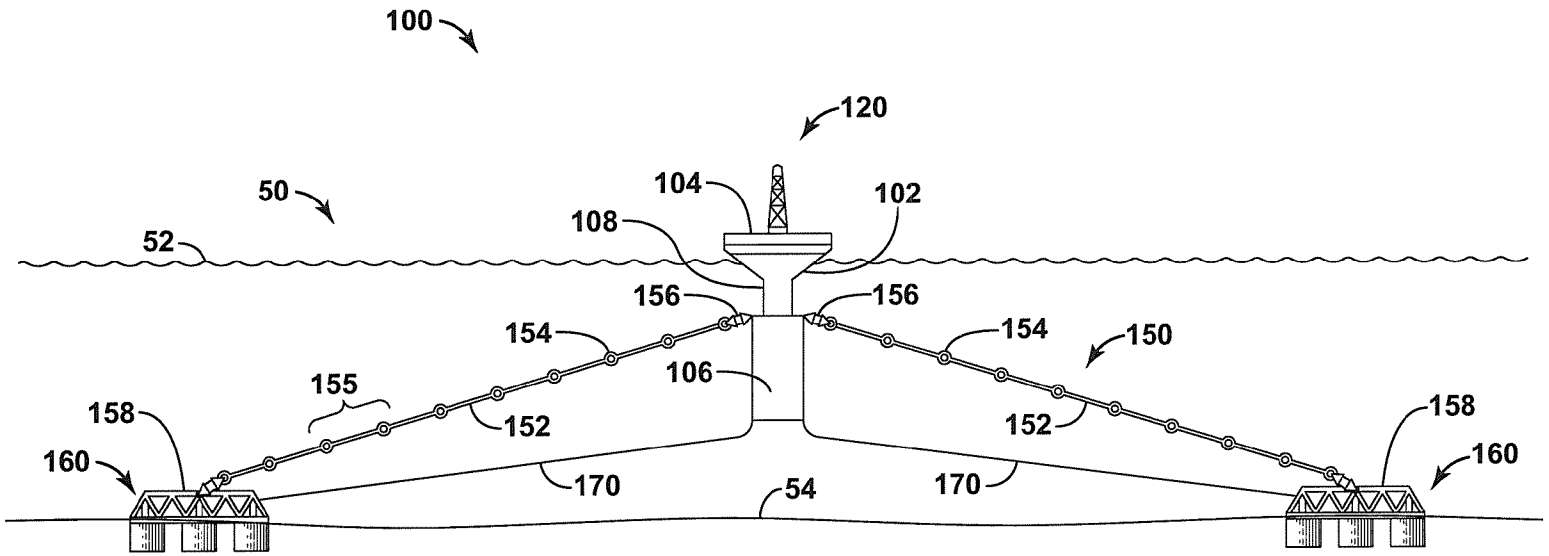
FIG. 1 is a side view of a mooring system of the present invention, in one embodiment, for a floating offshore drilling unit. A floating offshore drilling unit is seen in a marine environment.

FIG. 1 presents a side view of an offshore drilling unit 100. The offshore drilling unit 100 includes an inverted, generally conical drilling hull 102. A top side of the hull 102 comprises a platform 104 on which drilling operations take place. A drilling rig 120 is seen extending above the platform 104. The platform 104 supports additional drilling and production equipment not illustrated. The drilling hull 102, the platform 104, and the associated drilling and production equipment together comprise a drilling structure.

The offshore drilling unit 100 also includes a floating tower 106. In this illustrative arrangement, the tower 106 defines a substantially cylindrical body that floats in a body of water in an upright position. Such a structure is sometimes referred to in the marine industry as a "caisson." However, the illustrative tower 106 is not limited to caissons or other specific tower arrangements. The tower 106 is connected to a bottom side of the drilling hull 102 by means of a neck 108. Thus, as the tower 106 floats in accordance with Archimedes principle, it supports the drilling hull 102 and accompanying drilling operations.

The floating tower 106 contains controllable ballast compartments to keep the structure upright and stable. The tower 106 may additionally be used as a storage facility for equipment and supplies.

The offshore drilling unit 100 is shown in a marine environment 50. More specifically, the offshore drilling unit 100 is shown floating in an arctic body of water. A water line is seen at 52 while a seabed or subsea floor is seen at 54. In the view of FIG. 1, the marine environment 50 is substantially free of ice. Thus, it is in a condition where marine waves act upon the drilling unit 100 in response to wind and water currents. However, it is understood that the drilling unit 100 is designed to operate year-round in an arctic environment, including the cold winter months when substantially icy conditions prevail in the marine environment.

In order to maintain the position of the drilling unit 100 in the marine environment 50, a mooring system 150 is provided. The use of a mooring system 150 provides what is known as "station-keeping." Station-keeping is important during drilling operations to maintain the drilling unit 100 in proper position over the seabed 54 while a wellbore (not shown) is being formed.

The mooring system 150 first includes a plurality of anchors 160. In the view of FIG. 1, only two anchors 160 are shown. However, it is understood that the mooring system 150 preferably includes at least four and, more preferably six to ten anchors 160. Each anchor 160 rests on the seabed 54 at a designated distance from the tower 106. The anchors 160 are disposed radially around the tower 106 along the seabed 54.

The mooring system 150 also includes a plurality of mooring lines 152. Each mooring line 152 has a first end connected to the tower 106, and a second end connected to a respective anchor 160. In the arrangement of FIG. 1, a first pivoting bracket 156 connects the first end of each mooring line 152 to the tower 106, while a second pivoting bracket 158 connects the second end of each mooring line 152 to a respective anchor 160.

It is preferred that mooring line 152 be connected to the tower 106 at an upper end of the tower 106. The mooring lines 152 may be hung from tower 106 in a catenary fashion. However, unlike conventional wire rope used as a mooring line, the mooring lines 152 of the present invention are preferably maintained in a state of tension. In this respect, it is not necessary in an arctic marine environment to give the mooring line 152 slack, as the shallow nature of the water and the almost annual presence of ice minimizes marine wave forces.

Each mooring line 152 comprises a plurality of links 155. The links 155 are joined together using pivoting connectors 154. The connectors 154 may be, for example, pins placed through aligned through-openings. Alternatively, the connectors are u-joints or other pivoting connection means.

In the present inventions, the mooring lines 152 are not conventional wires, chains or cables; rather, the mooring lines 152 define multiple links 155 of substantially rigid members. Each link 155 may represent, for example, a set of two or three individual eyebars in parallel. The links 155, in turn, are connected at respective ends by the connectors 154.

Figure 2A:
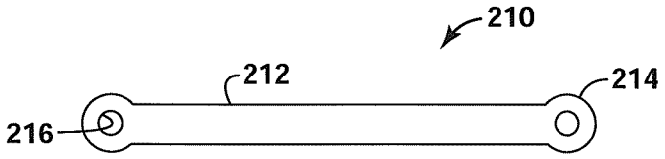
FIG. 2A shows a side view of an eyebar as may be used as part of a linking joint for a mooring system herein.
Figure 2B:
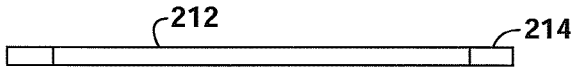
FIG. 2B is a plan view of the eyebar of FIG. 2A.

FIG. 2A shows a side view of a single eyebar 210. FIG. 2B presents a top view of the eyebar 210 of FIG. 2A. As seen from the two views together, the eyebar 210 includes an elongated body 212. At opposing ends 214 of the body 212 are through-openings 216. The through-openings receive respective connecting pins (not shown).

The eyebar 210 may be used as part of a link 155 for the mooring system 150 herein. The eyebar 210 defines an elongated steel or other metal body. However, other materials such as fiberglass, ceramic or composites may be considered. The eyebar 210 may be, for example 5 to 50 meters in length. In addition, the eyebar 210 may be about 1,000 mm in height and 250 mm in width. This creates a cross-section of 25,000 mm. This, in turn, provides a tensile capacity of 100 Mega-Newtons or more for the eyebars 210. This amount is to be contrasted with a typical wire rope used in a conventional mooring system that has a cross-section of about 6 inches with a corresponding tensile capacity of about 15 Mega-Newtons. Hence, an increase in capacity is accomplished by the increased steel area available to resist tension loads.

Figure 3A:
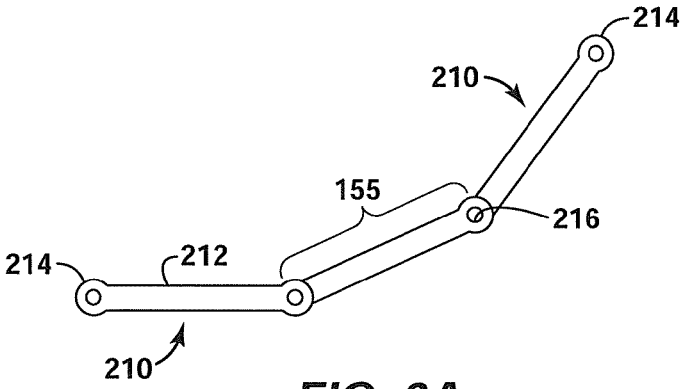
FIG. 3A provides a side view of a portion of a mooring line as may be used in the mooring system of FIG. 1. Three illustrative links are shown connected together.

As indicated in FIG. 1, a plurality of links 155 is joined to form a single mooring line 152. FIG. 3A shows a side view of three links 155 of eyebars 210. The links 155 represent a portion of a mooring line as may be used in the mooring system 150 of FIG. 1. The through-openings 216 of eyebars 210 of adjacent links 155 are aligned and pinned. This provides relative pivotal motion as between the links 155.

Figure 3B:
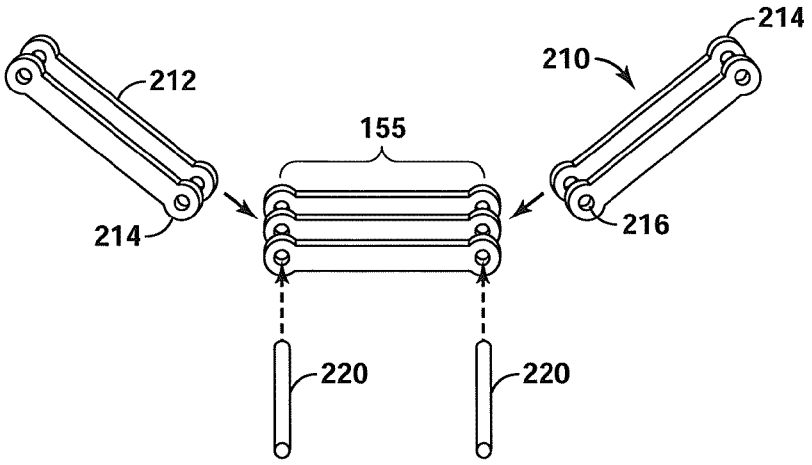
FIG. 3B is a perspective view of the portion of the mooring line of FIG. 3B. In this view, pins used for joining links of the mooring line are shown exploded from the eyebars.

FIG. 3B presents a perspective view of the eyebar links 155 of FIG. 3A. Here, the adjacent links 155 are seen in exploded-apart relation. It can be seen that each link 155 may include two or even three eyebars 210. The use of multiple eyebars 210 in a link 155 provides additional tensile capacity to a mooring line 152. In one aspect, each link 155 includes three to eight eyebars 210. The number of eyebars used will depend on such factors as the cross-sectional area of the individual eyebars 210 and the desired station-keeping capacity. Adding eyebars 210 may increase line capacity up to 600 MN, for example.

In order to form a mooring line 152, the individual eyebars 210 of a link 155 are placed in parallel position. The through-openings 216 of the eyebars 210 are again aligned. Pins 220 are then placed through the through-openings 216 of parallel eyebars 210. Pins 220 as may be used for joining links 155 of the mooring line 152 are shown exploded from the eyebars 210.

Figure 4A:
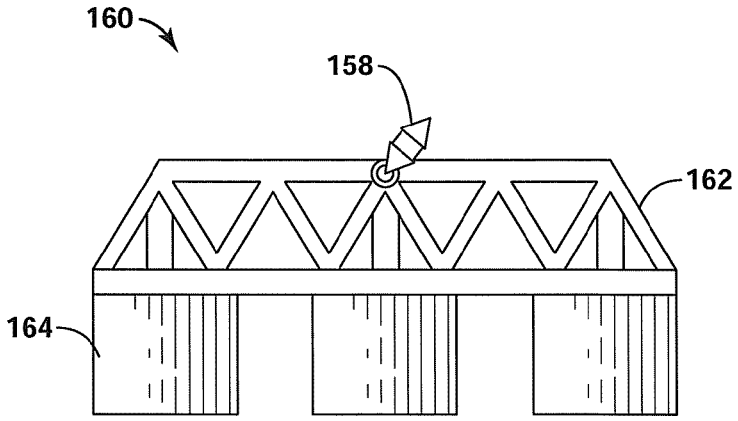
FIG. 4A presents a side view of an anchor as may be used in the mooring system of FIG. 1. Here, the anchor is fabricated from individual suction piles connected via a framing structure.
Figure 4B:
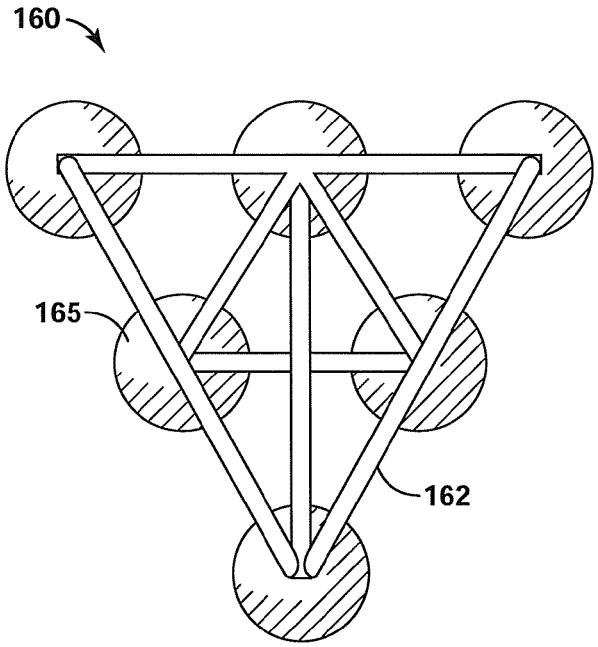
FIG. 4B is a plan view of the anchor of FIG. 4A.

As noted, the mooring lines 152 are connected at a second end to respective anchors 160. FIG. 4A is a side view of an illustrative anchor 160 as may be used in the mooring system 150 of FIG. 1. FIG. 4B is a plan view of the anchor 160 of FIG. 4A. As shown together in FIGS. 4A and 4B, the anchor 160 comprises a collection of individual piles members 164. The piles 164 are preferably designed to be attached to the seabed 54 by pile driving, suction driving, or other means known in the art.

The piles 164 are connected through a framing structure 162. The framing structure 162 is preferably a lattice of steel elements connected to the piles 164 and welded together. The framing structure allows the connection to take place between a mooring line 152 and the anchor 160 at different places along the anchor 160. This, in turn, allows the mooring system 150 to better accommodate the length of an individual mooring line 152.

The suction pile anchor 160 is able to resist the tension of the mooring line 152 by frictional and hydrostatic forces imposed on the anchor 160. Because the size requirements of a single suction pile anchor 160 may preclude its fabrication and installation, a group of smaller piles arranged in a structure frame as shown in FIGS. 4A and 4B can provide the required resistance. The specific number, diameter, penetration and spacing of the piles is specific to a particular application.

Figure 5A:
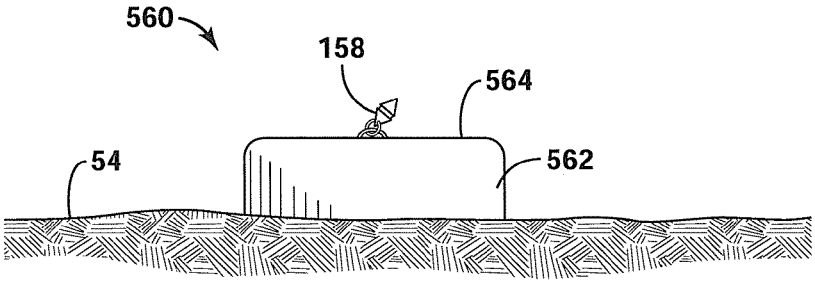
FIG. 5A is a side view of an anchor as may be used in the mooring system of FIG. 1, in an alternate embodiment. Here, the anchor is a block gravitationally held on a seabed.
Figure 5B:
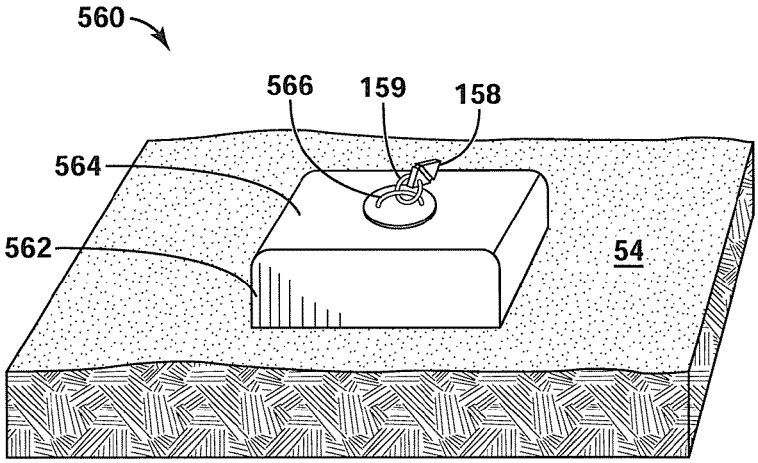
FIG. 5B is a perspective view of the anchor of FIG. 5A.

The anchor embodiment 160 of FIGS. 4A and 4B is not the only possible embodiment for an anchor. FIG. 5A is a side view of an anchor 560 as may be used in the mooring system of FIG. 1, in an alternate embodiment. FIG. 5B is a perspective view of the anchor of FIG. 5A. Here, the anchor 560 is a block 562 gravitationally held on the seabed 54.

The block 562 is preferably fabricated from concrete that is reinforced with steel rebar. The block forming the anchor 560 may be, for example, 100 meters long, 100 meters wide and 44 meters thick. Other dimensions, of course, may be employed. The gravity-based anchor 560 resists the tension of the mooring line 152 by its weight. The weight provides resistance to the vertical component of tension generated within the mooring line 152. At the same time, the weight provides frictional resistance to the horizontal component of the tension.

It can be seen in both FIGS. 5A and 5B that a pivoting connection member 158 is provided on a top surface 564 of the anchor 560. The connection member 158 is secured by a steel o-ring 159 or other means. The o-ring 159, in turn, is secured to a steel c-ring 566 cemented in place in the top surface 564 of the block 562.

Figure 5C:
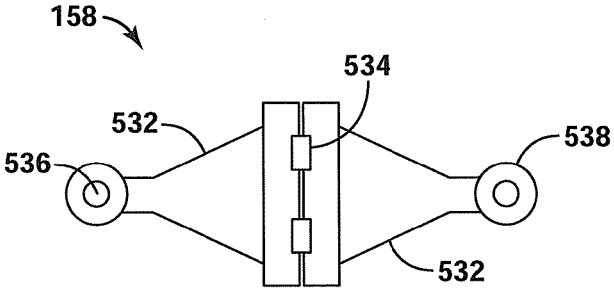
FIG. 5C provides a side view of a connection member as may be used to connect a mooring line to the anchors of FIG. 4B or FIG. 5B.

FIG. 5C is a side view of the connection member 158 as may be used to connect a mooring line 152 to the anchors of FIG. 4B or FIG. 5B. The illustrative connection member 158 defines two steel plates 532 connected by a pair of hinges 534. At opposing ends 538 of the plates 532 are through-openings 536. The through-openings 536 may be aligned with through-openings 216 in ends 214 of a set of parallel eyebars 210, and then pinned for a secure, pivoting connection.

It is understood that the connection member 158 of FIG. 5C is merely illustrative. Any connection member that allows for a pivoting connection between a mooring line 152 and an anchor (such as anchor 160) may be used. It is also noted that the connection member 158 of FIG. 5C may be used as a connection member for connecting the mooring line 152 to the tower 106.

In some instances it is desirable to disconnect the tower 106 from the drilling unit 120. One such example is when the drilling unit is to be towed to another offshore location for new drilling operations. Another example is when the drilling unit 120 is in the oncoming path of a large iceberg or other extreme ice feature. In either instance, a problem arises when disconnecting the tower 106 and lowering it to the seabed 54. In this respect, the jointed mooring lines 152 of the present invention are designed to accommodate the lowering of the tower 106 by kinematically collapsing.

Figure 6A:
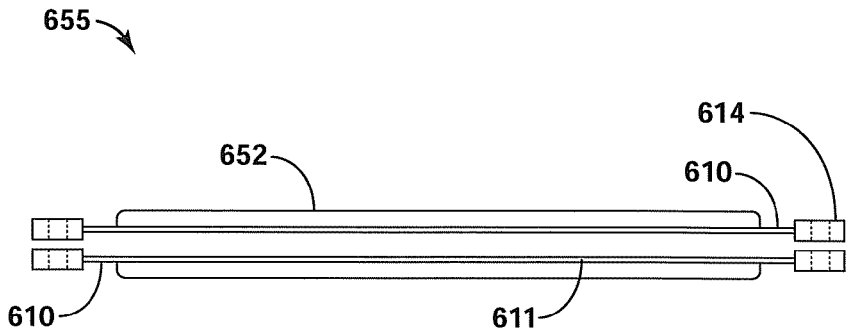
FIG. 6A presents a plan view of a link fabricated from one or more eyebars as may be used as part of a link for a mooring system herein, in an alternate embodiment. Here, the link is fabricated in part from a material that imbues buoyancy.
Figure 6B:
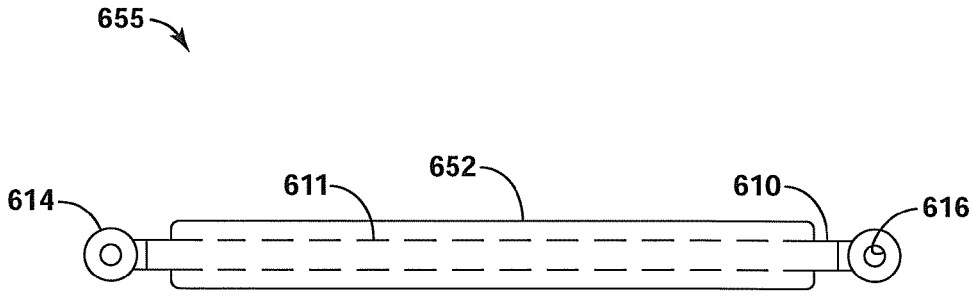
FIG. 6B is a side view of the link of eyebars of FIG. 6A.

To control this situation, selected links 155 of the mooring lines may be endowed with a buoyant characteristic. FIG. 6A is a plan view of a link 655 of eyebars 610 as may be used as part of a linking joint for the mooring system 150 herein, in an alternate embodiment. FIG. 6B is a side view of the link 655 of eyebars 610 of FIG. 6A.

The illustrative link 655 includes two parallel eyebars 610. However, a different number of eyebars 610 may be employed. In FIG. 6B, an eyebar 610 is seen primarily in phantom.

Each eyebar 610 defines an elongated body 611 having opposing ends 614. Each end 614 has a through-opening 616. The through-openings are configured and dimensioned to receive a pivoting connector such as a pin (not shown). The pivoting connector connects adjacent ends 614 of eyebars 610, thereby providing a connection.

In the arrangement of FIGS. 6A and 6B, the link 655 is fabricated in part from a material that imbues buoyancy to the link. Buoyancy is defined as the difference in weight between the buoyancy material and the weight of sea water of the same volume. The buoyant material is seen at 652. Buoyant materials are known in the offshore oil and gas industry and are generally fabricated from low-density, water-impermeable materials. An example of a buoyancy material is syntactic foam having a density as low as 29 pounds per cubic foot. Each cubic foot of material weighing 29 pounds in sea water provides 35 pounds of buoyancy. Densities of 36 pounds per cubic foot may be required for depths to 6,500 feet.

U.S. Pat. No. 3,622,437, entitled "Composite Buoyancy Material," discloses a buoyancy material having hollow spheres made of a thermoplastic resin, encased in a matrix of syntactic foam. The buoyancy material is said to offer a density as low as 18 to 22 pounds per cubic foot. Other buoyancy materials may be used such as solid syntactic foam containing no minispheres as offered by Flotation Technologies of Biddeford, Me. The present inventions are not limited to the type or source of buoyancy material, if any.

The buoyancy material 652 may be secured in pieces to opposing sides of selected eyebars 610. Alternatively, the buoyancy material 652 may be wrapped completely around individual eyebars 610 or around a substantial length of a link 655. Only selected links 655 will receive buoyancy material 652. Alternatively, all links will have some buoyancy material 652, but the degree of buoyancy will be selectively alternated as between links or groups of links.

The links 655 are designed not only to reduce downward load that might otherwise be applied by the mooring system 150 to the drilling unit 100, but also to improve collapsibility of the mooring lines 152. This is of benefit when it is desirable to disconnect the tower 106 from the drilling structure 120 so that the drilling structure 120 may be towed to another offshore location. This is of particular benefit should the operator desire to quickly avoid a collision by an oncoming iceberg.

Figure 7A:
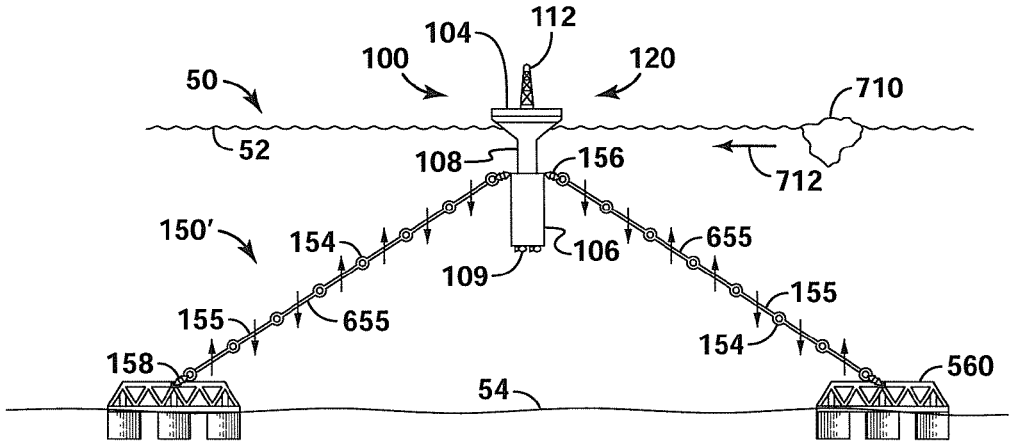
FIG. 7A is a side view of a mooring system for a floating offshore drilling unit, in an alternate embodiment. In this view, the caisson is attached to the bottom of the drilling structure. The links in the mooring system are in accordance with the illustrative example of FIGS. 6A and 6B.

FIG. 7A is a side view of a mooring system 150', in an alternate embodiment, for a floating offshore drilling unit 100. The offshore drilling unit 100 is again shown in a marine environment 50. A water line is seen at 52 while a seabed or subsea floor is seen at 54. Unlike the marine environment 50 of FIG. 1, the marine environment 50 of FIG. 7A includes a large ice mass 710, or ice sheet. The ice sheet 710 is moving along a path indicated by arrow 712. The drilling unit 100 is shown in that path.

The drilling structure 120 and attached tower 106, making up the drilling unit 100, are in position for offshore oil and gas operations. Such operations may include drilling, remediation or production. In the view of FIG. 7A, the tower 106 remains attached to the neck 108 of the drilling structure 120.

The drilling unit 100 is maintained in place by a mooring system 150. The mooring system 150' is comprised of a plurality of anchors disposed radially around the tower along the seabed 54. In addition, the mooring system 150' comprises a plurality of mooring lines 152. Each mooring line 152 once again has a first end operatively connected to the tower 106 and a second end operatively connected to a respective anchor, such as anchor 560 of FIG. 5A.

Each mooring line 152 includes a plurality of links 155, 655. The links 155, 655 are linked together using linkages such as a pin received within the through-openings 216 of FIG. 2A. In the mooring system 150' of FIG. 7A, selected links 655 include a buoyancy material such as buoyancy material 652. Those links 655 are biased to float upward, that is, they have slightly positive buoyancy, while the links 154 want to sink, that is, they have slightly negative buoyancy. Links 655 are indicated with upward-pointing arrows, while links 155 are indicated with downward-pointing arrows.

Figure 7B:
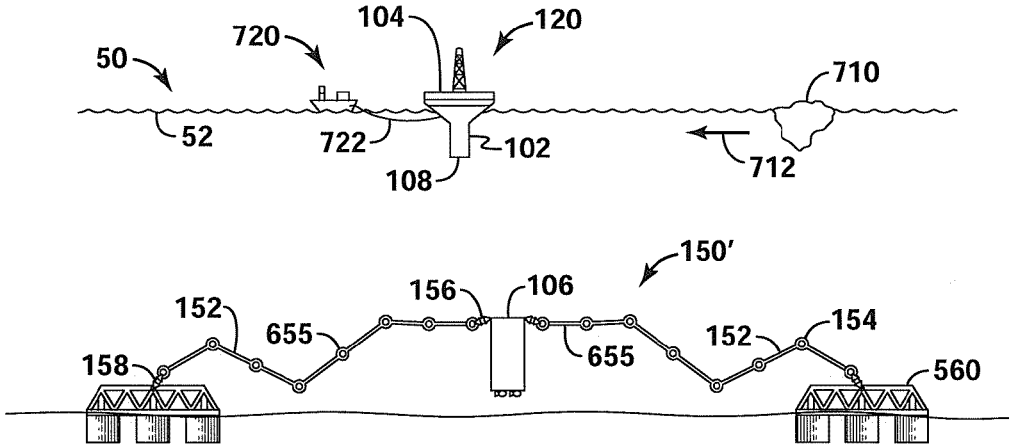
FIG. 7B is a side view of the mooring system of FIG. 7A. However, the caisson has been detached from the drilling structure and has been lowered within a marine environment. This allows the drilling structure to be towed out of a line of impact with an iceberg.

FIG. 7B is a side view of the mooring system of FIG. 7A. Here, the tower 106 has been detached from the drilling structure 120. The tower 106 has also been lowered within the marine environment near the seabed 54. This allows the drilling structure 120 to be towed out of the line of impact (shown by arrow 712) with the ice sheet 710. It also allows the iceberg 710 to clear the tower 106.

It can be seen in FIG. 7B that a vessel 720 has been connected to the drilling structure 120. The vessel 720 is pulling the drilling structure 120 away from the ice sheet 710. In this way the drilling structure 120 is spared impact by the ice sheet 710.

To enable the tower 106 to be lowered to the seabed 54, the mooring lines 152 need to be able to collapse. It can be seen in FIG. 7B that the mooring lines 152 have collapsed. The links 155 within the lines 152 having no or slightly negative buoyancy tend to sink, while the links 655 having a buoyancy material tend to float. In this way, the mooring system 150' can accommodate "compression" as the tower 106 is lowered to a water depth out of harm's way of the approaching ice sheet 710.

Another feature that may optionally be provided as part of the mooring systems herein is the ability to adjust the level of flotation by the drilling unit 100. Stated another way, it is desirable to change the draft of the drilling unit 100. Those of ordinary skill in the art will understand that the draft is the distance from the water line 52 to the deepest part of the tower 106.

During the winter season and other cold-weather months, the marine environment will be extremely icy, and the drilling unit will be subject to primarily ice loading (as opposed to wave loading). During this time, it is preferable that the conical-shaped drilling hull 102 be positioned in the water so that the conical portion of hull 102 sits in the water to provide the main contact point for the ice. This provides greater ability to withstand forces produced by ice sheets. It also ensures that ice loading is always horizontal and vertically upward, thus, not tending to sing the floating drilling unit 100.

Figure 7C:
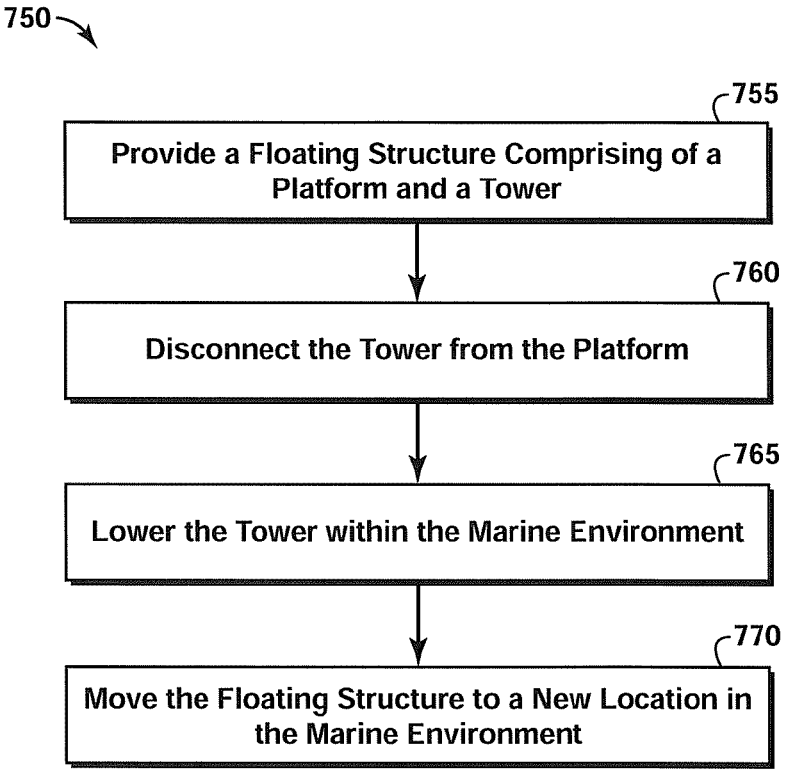
FIG. 7C is provides a flow chart showing steps for a method for relocating a floating arctic structure.

FIG. 7C provides a flow chart showing steps for a method 750 for relocating a floating arctic structure. The method 750 first comprises providing a floating structure. This is shown at Box 755. The floating structure may be, for example, the drilling unit 100 of FIG. 1.

The floating structure generally includes a platform on which operations are performed in a marine environment. The floating structure also includes a tower for providing ballast and stability below a water line in the marine environment. Further, the floating structure is originally stationed in the arctic marine environment by means of a mooring system. The mooring system comprises a plurality of mooring lines having a first end and a second end, wherein each mooring line has at least two substantially rigid links joined together using pivoting connections. The mooring system also includes a plurality of anchors placed along the seabed. Each anchor secures a respective mooring line at the second end of the mooring line. The mooring system may be, for example, the mooring system 150 or the mooring system 150'.

The method 750 also includes disconnecting the tower from the platform. This is shown at Box 760. Those of ordinary skill in the art will understand that the tower can be mechanically disconnected from an offshore operations platform while the structure is still in the water.

The method 750 next includes lowering the tower within the marine environment. This step is shown at Box 765. The tower is lowered to a depth below the depth of an oncoming ice sheet. The pivoting connections in the mooring lines permit the mooring lines to kinematically collapse as the tower is lowered into the marine environment.

The method 750 also includes moving the floating structure to a new location in the marine environment. This is indicated at Box 770 of FIG. 7C. The new location will, of course, be out of the line of approach by the ice sheet. In this way the floating structure is spared impact with the ice sheet.

Figure 8A:
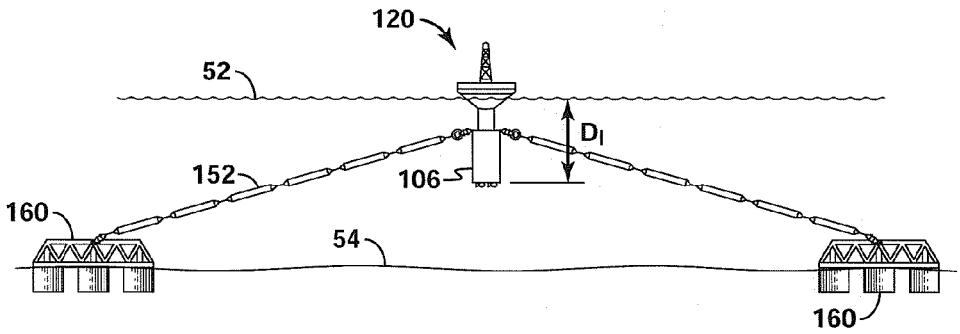
FIG. 8A is a side view of the mooring system for a floating offshore drilling unit of FIG. 1. In this view, the mooring system is arranged to position the drilling structure at the water line for substantially icy conditions.

FIG. 8A is a side view of the mooring system 150 for the floating offshore drilling unit 100 of FIG. 1. In this view, the mooring system 150 is arranged to position the drilling structure 120 and the attached floating tower 106 so that the conical portion of the hull 102 sits in the water to provide the main contact point for the ice. The draft of the drilling structure 120 is indicated at $D_I$.

During the summer season when the marine environment experiences waves, it is preferable to elevate the conical-shaped drilling hull 102 out of the path of incoming waves. In this manner, the waves contact a minimum structural exposure of the drilling structure 120, that is, the "neck" portion of the drilling unit 100. This is done by reducing the draft.

Figure 8B:
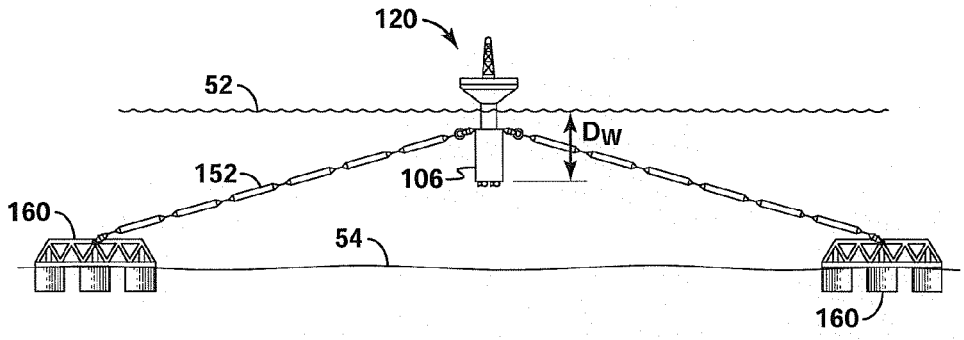
FIG. 8B is another side view of the mooring system of FIG. 1. Here, the mooring system has been arranged to position the drilling structure substantially above the water line for marine wave conditions.

FIG. 8B is another side view of the mooring system 150 of FIG. 1. Here, the mooring system 150 has been arranged to position the drilling structure 120 to sit higher above the water line 52. This allows the drilling structure 120 to be more stable in the face of marine wave conditions. The reduced draft is indicated at $D_W$.

In a known and conventional wire rope mooring system, the length of the various mooring lines can be readily adjusted to accommodate changes in draft. For example, the individual lines may be winched at the connection with the floating vessel. However, with the mooring lines 155 or 655 that employ mechanical linkages, it may be difficult to manufacture lines that will allow adjustment in length. Therefore, a unique adjustment system is provided for the mooring lines as one option herein.

The adjustment system, in one embodiment, employs a selectively pivoting "dog bone" link. This "dog bone" link may be included as part of the respective mooring lines 150, or excluded as needed. Preferably, the "dog bone" link is maintained in the mooring lines 150 even when not in use. This is demonstrated in FIG. 9.

Figure 9:
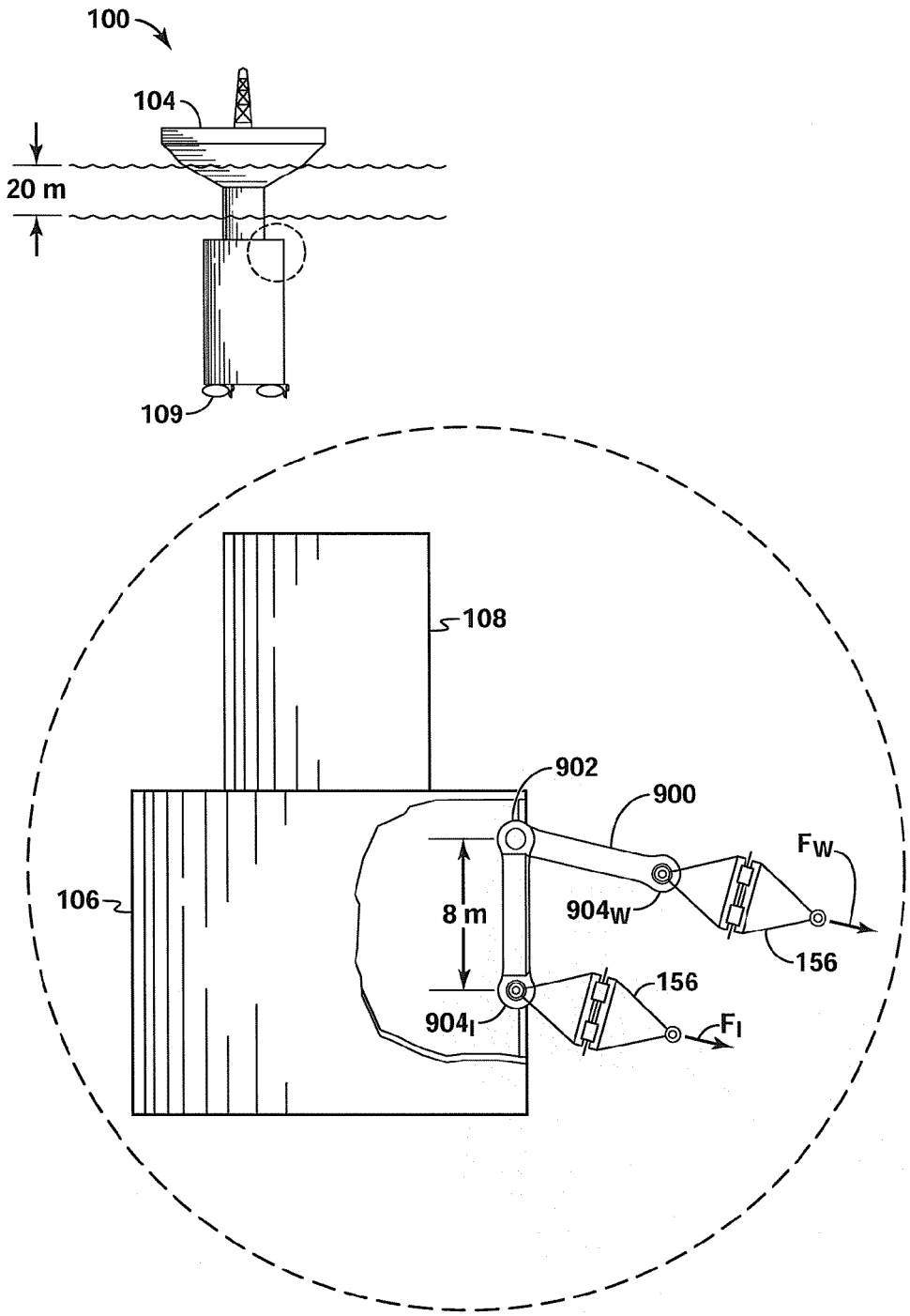
FIG. 9 is an enlarged side view of an upper portion of the tower of a drilling unit. A pivoting eyebar is shown in alternate positions for raising and lowering the drilling structure to accommodate either the substantially icy conditions of FIG. 8A, or the substantially marine wave conditions of FIG. 8B.

FIG. 9 is an enlarged side view of an upper portion of the floating tower 106 of a drilling unit 100. Shown in this side view is a pivoting "dog bone" link 900. The "dog bone" link 900 pivots about pin 902 at a proximal end of the dog bone link 900. A distal end 904 of the dog bone link 900 opposite the pin 902 is provided. This distal end 904 is attached to a connecting member 156, which in turn is connected to a mooring line (not shown).

In one arrangement, the pivoting dog bone link 900 pivots freely from the tower 106. In this position, the distal end of the link 900 is indicated at 904*w*. The corresponding coordinate of force acting against the tower 106 by the mooring line is shown at $F_w$. In this position, the length of the mooring line is effectively extended. This, in turn, allows the tower 106 and connected drilling structure 120 to be positioned in the marine environment to avoid waves in accordance with FIG. 8B.

In an alternate position, the pivoting dog bone link 900 is prevented from pivoting away from the tower 106. In this position, the distal end of the link 900 is indicated at $\mathbf{904}_I$. The corresponding coordinate of force acting against the tower 106 by the mooring line is shown at $F_I$. In this position, the length of the mooring line is effectively reduced. This, in turn, causes the tower 106 and connected drilling structure 120 to be lowered in the marine environment to better withstand ice forces. This also reduces the draft so that the draft is in position $D_I$ in accordance with FIG. 8A.

It can be see from FIG. 9 that a relationship exists between the secured location of the dog bone link 900 and the change in draft. The relationship is primarily a function of the mooring line angle. For an 8 meter long dog bone link and a line angle of about 15 degrees, the dog bone will provide a 20 meter change in draft. The 20 meter difference is demonstrated in FIG. 9. Other dog bone link lengths can be used to effectuate larger or smaller drafts.

It is understood that the pivoting dog bone link 900 shown in FIG. 9 is merely illustrative. Other adjustable connection arrangements may be employed for changing the draft of the drilling unit 100 between $D_I$ and $D_W$. For example, the operator may simply add or remove the dog bone link 900 depending on the water condition. Either arrangement allows the operator to raise and lower the drilling unit 120 to accommodate either the substantially icy conditions of FIG. 8A, or the substantially marine wave conditions of FIG. 8B.

Figure 17:
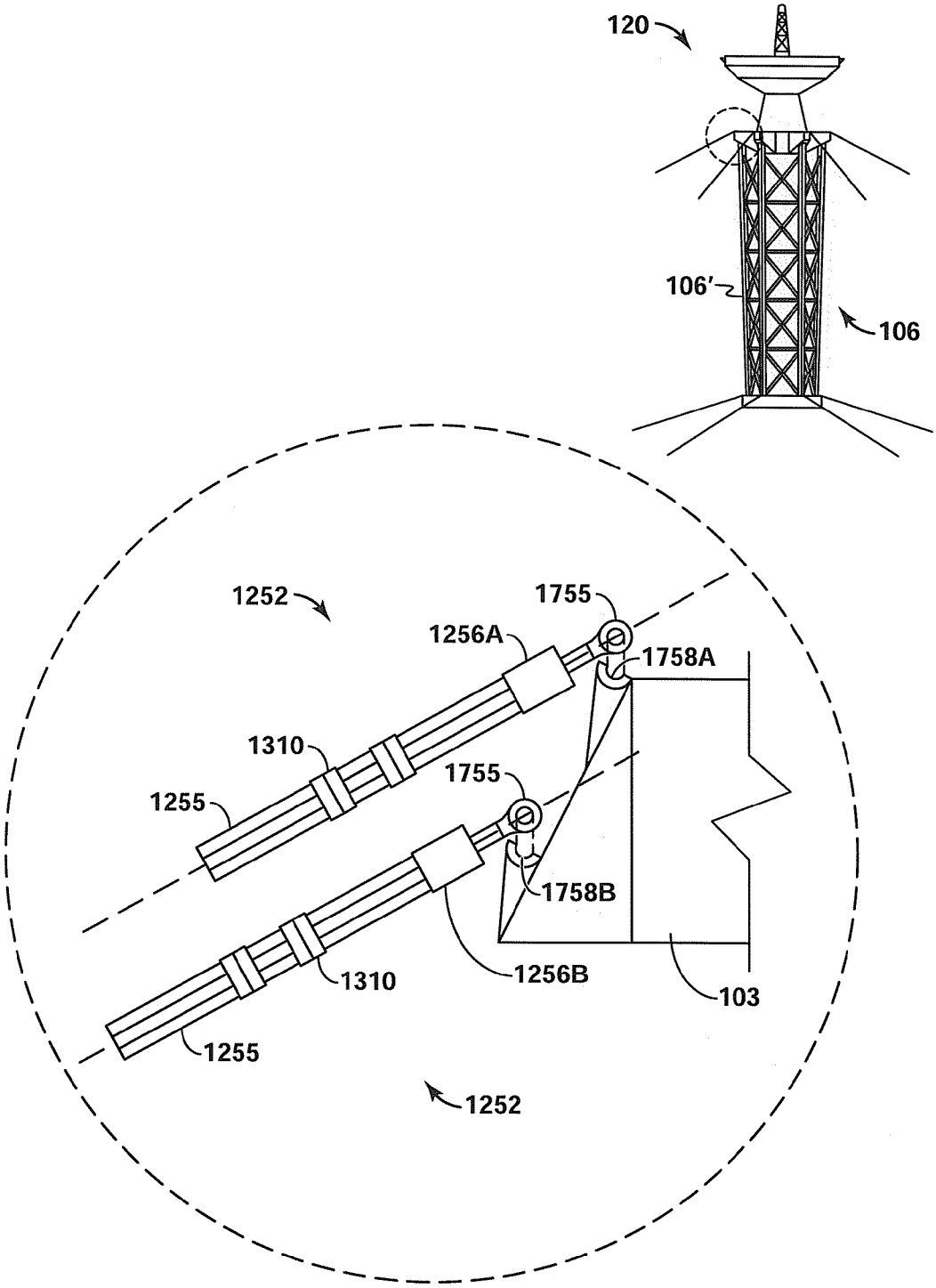
FIG. 17 is a side view of an upper portion of the floating tower of FIGS. 12A and 12B. The upper portion has been expanded to demonstrate the selective placement of an end of the mooring lines along the tower. In the illustrative arrangement, a semi-radial connector is provided at the very end of the connecting joint.

FIG. 17, discussed in further detail below, provides an alternate connection arrangement for repositioning the drilling unit 120. In the alternate connection mechanism, an end of the mooring lines may be selectively placed along the upper portion of a floating tower (seen at 106').

Figure 10:
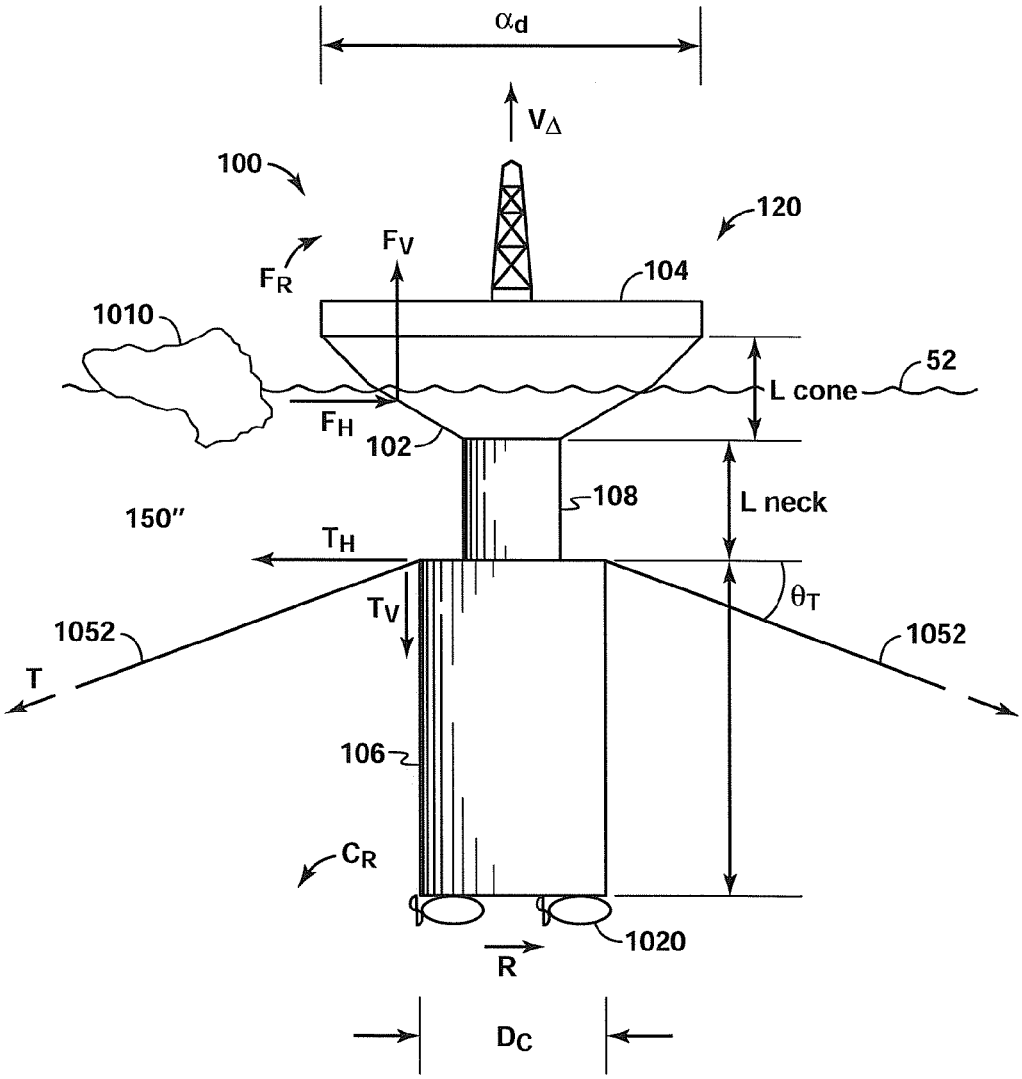
FIG. 10 is another side view of the mooring system for a floating offshore drilling unit of FIG. 1. Here, force vectors are shown indicating forces acting on the drilling unit when ice impacts the drilling unit. Thrusters provide active propulsion to help keep the floating structure balanced.

Referring now to FIGS. 1 and 10 together, another optional feature that may be provided as part of the mooring systems herein is the use of an active propulsion system. In one aspect, thrusters 1020 are employed for active propulsion at the bottom of the tower 106, 106'. When activated, the thrusters 1020 provide a force "R" within the water below the water line 52 that may be used to maintain the drilling unit 100 in an upright position.

FIG. 1 presents a pair of illustrative thrusters 109 at the bottom of the tower 106. The thrusters 109 represent an active or dynamic positioning system using sensors and computer-controlled propellers. The presence of thrusters 1020 provides thruster-assisted mooring. For example, the thrusters 1020 may be any type of propeller (e.g., a controllable pitch, fixed pitch, and/or counter-thrusting propeller), thruster, propulsor, or water jet, and may include features such as pitch control, tunnels for quieter operation, under water replacement, and retractability. Two exemplary propulsion devices are the AZIPOD® podded propulsor made by ABB and the Mermaid™ podded propulsor made by Kamewa™. This system comprises powerful (5-25 megawatts per propulsor) propulsors.

FIG. 10 provides a side view of a mooring system 150" for a floating offshore drilling unit of FIG. 1. Here, force vectors are shown indicating forces acting on the drilling unit 100 in response to impact from an ice sheet 1010. Because of the conical nature of the drilling hull 102, the ice sheet 1010 applies both a horizontal force $F_H$ and a vertical force $F_v$. The combined horizontal $F_H$ and vertical $F_v$ forces create an overturning or tilting force $F_R$ against the drilling unit 100.

A series of counter-forces act against the horizontal force $F_H$ and the vertical force $F_v$ of the ice sheet 1010. For basic hydrodynamic stability, a deep draft caisson or other tower provides a natural restoring moment. To increase this moment, a solid ballast may be added to the lower portion of the tower. Additional buoyancy may be added to the upper portion. This may be done, for example, by increasing the sizes of tankages in the upper 103 and lower 107 portions of the tower 106. When the tower 106 is tilted due to the application of ice sheet forces, the moment generated by the eccentricity of the gravity and buoyancy forces seeks to restore the tower 106 to a vertical position. Stated another way, the weight and dimension of the submerged tower 106 provides a tilting force $C_R$ that is opposite in direction to the tilting force $F_R$ created by the ice sheet 1010.

The mooring system 150 and component parts described above present only illustrative embodiments. Other mooring systems that employ a plurality of substantially rigid links connected together connections may be used. For example, in lieu of using one or more eyebars 210 to form a link 155, a plurality of long, hollow tubular members may be bundled together. In this instance, the link is much longer than the individual eyebars 210, and the number of connections may be substantially reduced.

Figure 12A:
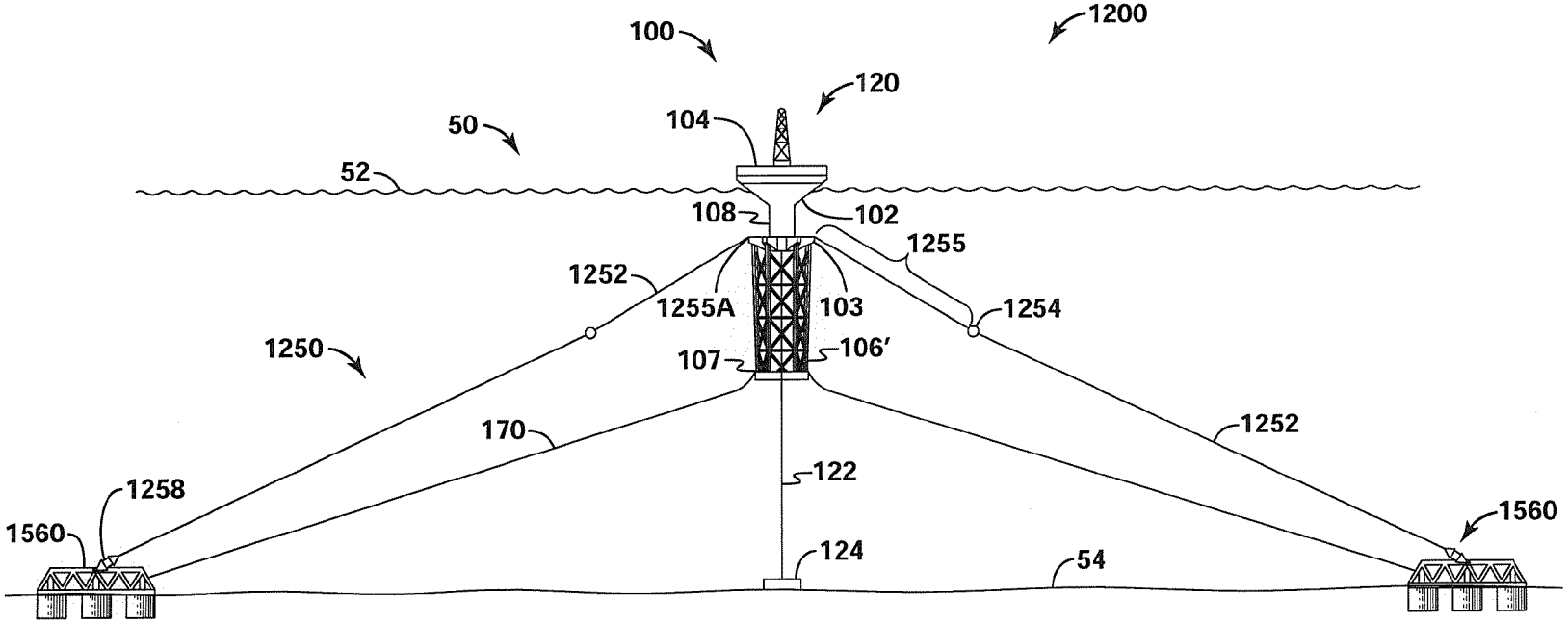
FIG. 12A is a side view of a mooring system of the present invention, in an alternate embodiment, for a floating offshore drilling unit. A floating offshore drilling unit is seen in a marine environment. In this arrangement, the mooring system is secured to a floating tower in such a manner as to position the drilling structure in the marine environment for substantially icy conditions.

FIG. 12A presents a side view of the offshore drilling unit 100. The offshore drilling unit 100 once again includes an inverted, generally conical drilling hull 102. The top side of the hull 102 comprises a platform 104 on which drilling operations take place. A drilling riser 122 is seen extending down from the platform 104, through pressure control equipment 124 on the seabed 54, and into the earth surface. The drilling hull 102, the platform 104, and the associated drilling equipment together comprise a drilling structure 120.

The offshore drilling unit 100 also includes a tower 106'. In this arrangement, the tower 106' defines an elongated framed structure that floats in the marine environment 50 in an upright position. The tower 106' is connected to a bottom side of the drilling hull 102 by means of a neck 108. An upper portion 103 and a bottom portion 107 of the tower 106' contain controllable ballast compartments (not shown) to keep the tower 106' upright and stable. An upper portion of the tower 106' may optionally be used for storage for drilling fluids and equipment.

The offshore drilling unit 100 is shown in a marine environment 50. More specifically, the offshore drilling unit 100 is shown floating in an arctic body of water. A water line is seen at 52 while a seabed or subsea floor is seen at 54. In the view of FIG. 12A, the marine environment 50 is substantially free of ice. Thus, it is in a condition where marine waves act upon the drilling unit 100 in response to wind and water currents. However, it is understood that the drilling unit 100 is designed to operate year-round in an arctic environment, including the cold winter months when substantially icy conditions prevail in the marine environment.

In order to maintain the position of the drilling unit 100 in the marine environment 50, a mooring system 1250 is provided. The mooring system 1250 is designed in a manner that is different from the mooring system 150 shown and discussed in connection with FIG. 1. However, as will be shown below in connection with FIGS. 13A-13C and 14A-14C, the mooring system 1250 also employs a plurality (at least two and preferably three or more) of substantially rigid links 1255 joined together by connectors 1254.

As with mooring system 150, mooring system 1250 also includes a plurality of anchors 1560. In the view of FIG. 12A, only two anchors 1560 are shown. However, it is understood that the mooring system 1250 preferably includes at least four and, more preferably six to ten anchors 1560. Each anchor 1560 rests on the seabed 54 at a designated distance from the tower 106'. The anchors 1560 are disposed radially around the tower 106' along the seabed 54. It is understood that "radially" does not imply a true circle, but means that the anchors 1560 are selectively placed away from the tower 106' and along the seabed 54 in such a manner as to fulfill the station-keeping function.

The mooring system 1250 also includes a plurality of mooring lines 1252. Each mooring line 1252 has a first end 1255A connected to the tower 106', and a second end 1258 connected to a respective anchor 1560. The first end is connected to the tower 106' at the upper end 103 of the tower 106'. In this position, the first end is designated as 1255A. This causes the tower 106' and attached drilling structure 120 to be positioned lower in the marine environment 50. As noted above in connection with FIG. 8A, this is advantageous when the marine environment 50 has substantially icy conditions.

Figure 12B:
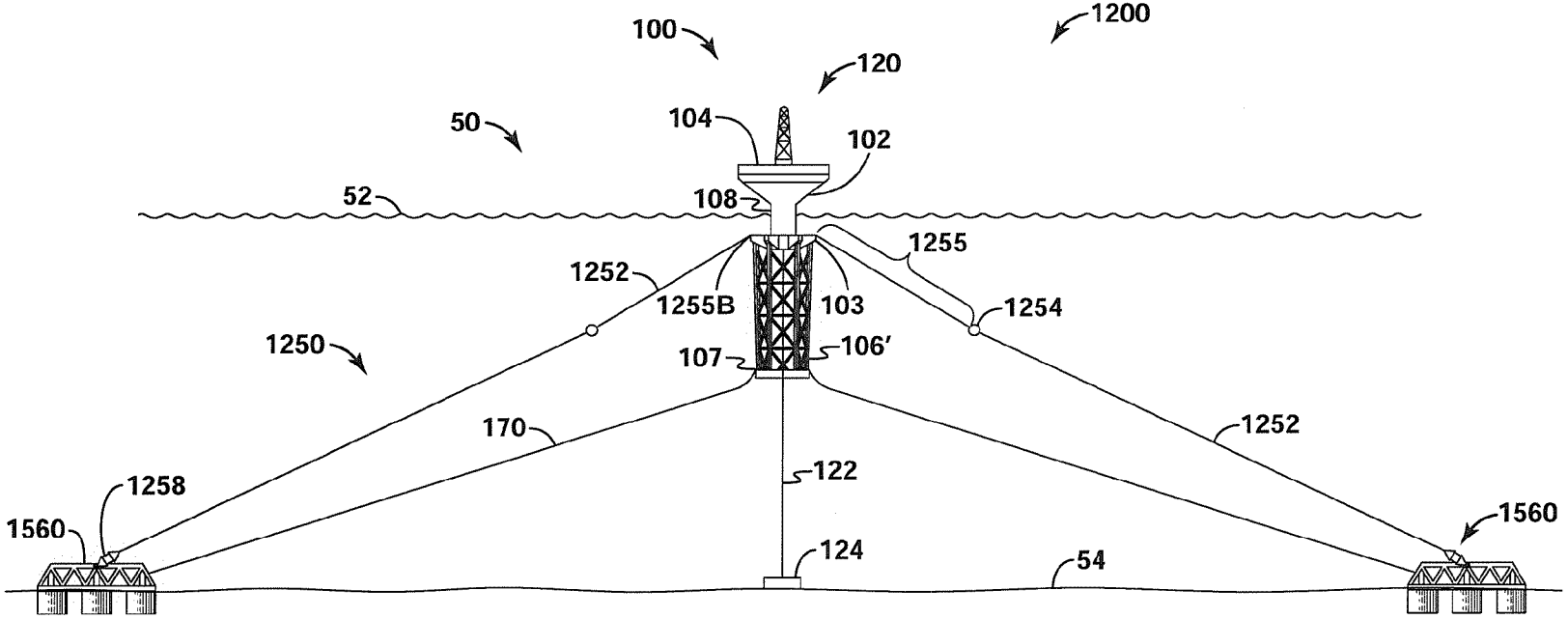
FIG. 12B is another side view of the mooring system of the present invention, in an alternate embodiment, for a floating offshore drilling unit. A floating offshore drilling unit is seen in a marine environment. In this arrangement, the mooring system is secured to a floating tower in such a manner as to position the drilling structure in the marine environment for substantially marine wave conditions.

FIG. 12B presents another side view of the offshore drilling unit 100. It can be seen that the offshore drilling unit 100 is now sitting higher in the water. As discussed in connection with FIG. 8B, this condition is advantageous when the marine environment is substantially free of ice. In this condition, marine waves act upon the drilling unit 100. Because the drilling hull 102 is well above the wave amplitude, wave forces are less than if the drilling unit 100 is positioned lower in the water.

To permit the drilling unit 100 to be positioned higher in the water, the first end is connected to the tower 106' at the upper end 103 of the tower 106', but at a lower relative point. In this position, the first end is designated as 1255B.

In the arrangements of both FIGS. 12A and 12B, the mooring lines 1252 may be hung from tower 106' in a catenary fashion. However, unlike conventional wire rope used as a mooring line, the mooring lines 1252 of FIG. 12A and FIG. 12B are preferably maintained in a state of tension.

Each mooring line 1252 comprises two or more rigid links 1255. In the illustrative arrangement of FIG. 12A, a pair of rigid links 1252 is provided in each mooring line 1250, while in FIG. 12B three rigid links 1252 are used. It is a matter of design judgment as to how many links 1252 are actually used for the respective mooring lines 1250, although it is preferred that the same number of links 1252 be used in each line 1250.

The links 1255 are connected together using connectors 1254. The connectors 1254 may be, for example, pins placed through aligned through-openings. Alternatively, the connectors 1254 may be u-joints or other pivoting connection means. In the present inventions, the mooring lines 1252 are not conventional wires, chains or cables; rather, the mooring lines 1252 define "tendons" 1255. Each tendon 1255, in turn, comprises a bundled set of three or more individual tubular members in parallel.

Figure 13A:
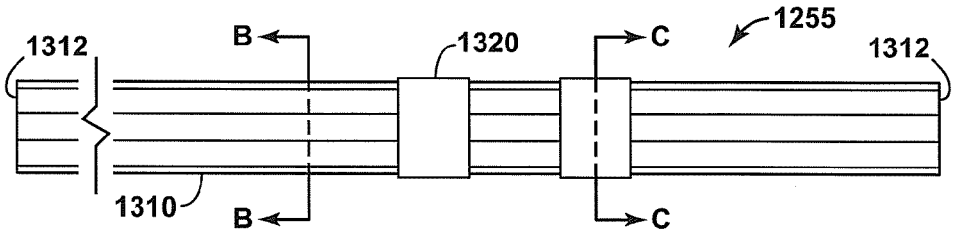
FIG. 13A is a side view of a mooring line as may be used in the mooring system of FIGS. 12A and 12B.

FIG. 13A provides a side view of a portion of a tendon 1255, in one embodiment. Various tubular members are seen at 1310. The tubular members 1310 have opposing ends denoted at 1312. The tubular members 1310 are bundled with clamps 1320 or other bundling means. The tubular members 1310, 1314 are preferably fabricated from steel due to high tensile strength. However, other materials such as fiberglass, ceramic or composites may be considered.

Figure 13B:
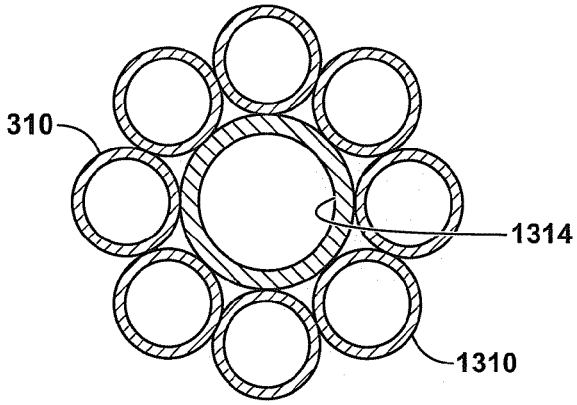
FIG. 13B provides a cross-sectional view of the mooring line of FIG. 13A, seen at line B-B of FIG. 13A. A plurality of tubular members is seen.
Figure 13C:
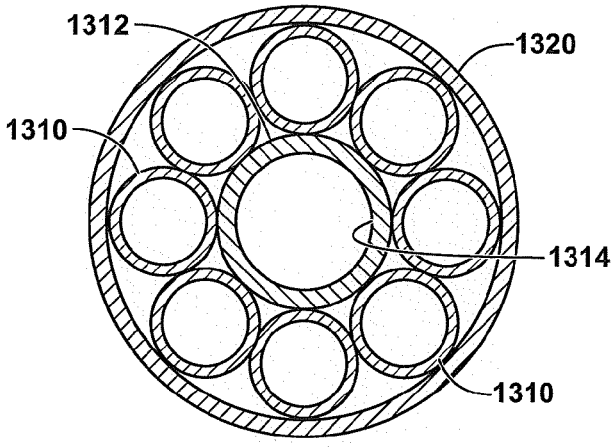
FIG. 13C presents another cross-sectional view of the mooring line of FIG. 13A, seen at line C-C of FIG. 13A. A plurality of tubular members is seen with an enclosing wrap to maintain relative position of the tubular members.

FIGS. 13B and 13C provide cross-sectional views of the tendon 1255 of FIG. 13A. FIG. 13B is taken across line B-B, while FIG. 13C is taken across line C-C. In this illustrative arrangement, eight outer tubular members 1310 are provided. The outer tubular members 1310 surround a single larger tubular member 1314. Each tubular member is hollow so as to provide buoyancy to the tendon 1255. In FIG. 13C, the clamp 1320 is seen bundling the tubular members 1310, 1314.

Figure 14A:
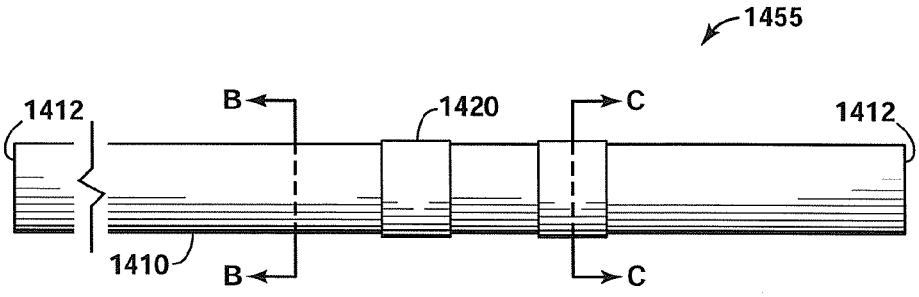
FIG. 14A is a side view of a mooring line as may be used in the mooring system of FIGS. 12A and 12B, in an alternate embodiment.

FIG. 14A provides a side view of a portion of a tendon 1455, in an alternate embodiment. Various tubular members are again seen at 1410. The tubular members 1410 have opposing ends denoted at 1412. The tubular members 1410 are once again bundled with clamps 1420 or other bundling means.

Figure 14B:
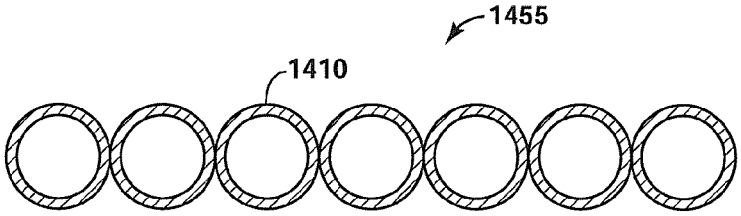
FIG. 14B provides a cross-sectional view of the mooring line of FIG. 14A, seen at line B-B of FIG. 14A. A plurality of tubular members is seen.
Figure 14C:
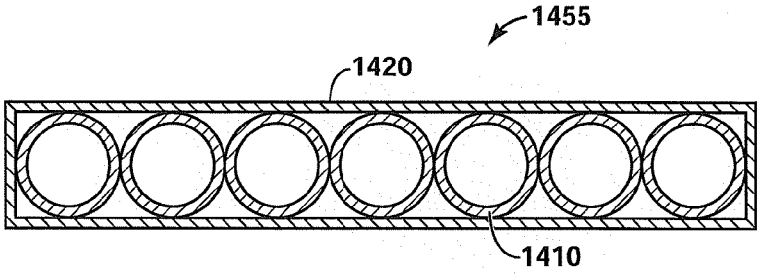
FIG. 14C presents another cross-sectional view of the mooring line of FIG. 14A, seen at line C-C of FIG. 14A. A plurality of tubular members is seen.

FIGS. 14B and 14C provide cross-sectional views of the tendon 1455 of FIG. 14A. FIG. 14B is taken across line B-B, while FIG. 14C is taken across line C-C. In this illustrative arrangement, seven tubular members 1410 are set out in a substantially linear fashion. Each tubular member 1410 is again hollow so as to provide buoyancy to the tendon 1455. In FIG. 14C, the clamp 1420 is seen bundling the tubular members 1410.

As discussed in connection with FIGS. 7A and 7B above, it is sometimes desirable to disconnect the drilling structure 120 from the tower 106'. This may occur, for example, when the drilling structure 120 is to be towed to shore for repairs or temporary storage. Another example is when the drilling unit 100 is in the oncoming path of a large iceberg. In either instance, a problem arises when disconnecting the tower 106' and lowering it towards the seabed 54. In this respect, the substantially rigid tendons 1255 or 1455 are not designed to bend in the presence of compressive forces.

Figure 15A:
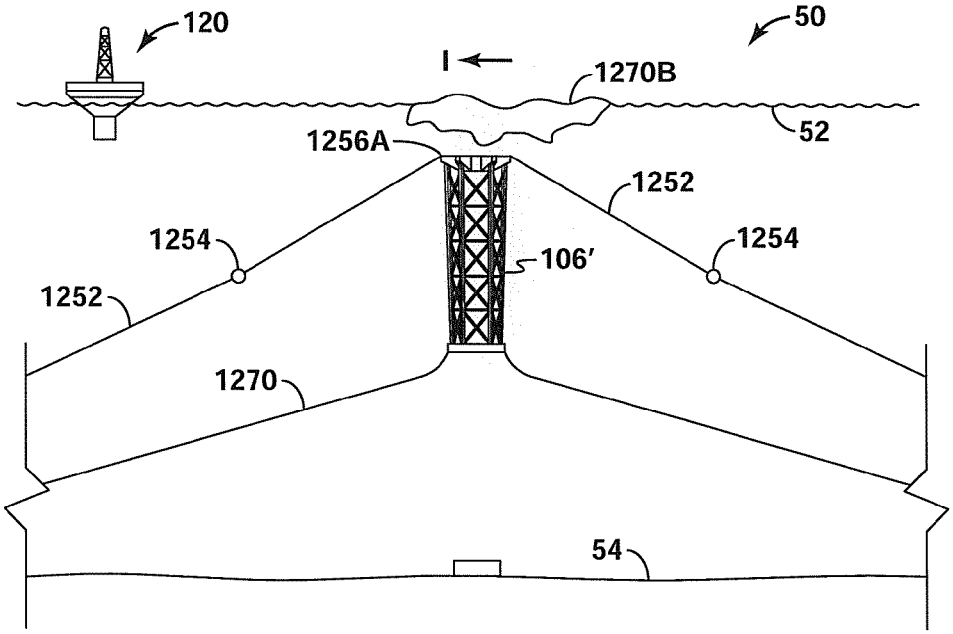
FIG. 15A shows a side view of a portion of the mooring system of FIGS. 12A and 12B. Here, the drilling structure has been disconnected from the floating tower. The tower is positioned in the marine environment to avoid contact with a large ice sheet.

To accommodate this situation, pivoting connectors 1254 provide the mooring lines 1252 with a degree of collapsibility. This is demonstrated in FIGS. 15A and 15B. First, FIG. 15A shows a side view of the mooring system 1250. The mooring system 1250 is connected to the tower 106'. It can also be seen in FIG. 15A that a large iceberg 1270B has moved in a direction "I" onto a location of the drill-site. However, the drilling structure 120 has been disconnected from the tower 106' and moved away from the drill-site and out of harm's way. Further, the tower 106' has been ballasted and lowered partway into the marine environment 52.

It can be seen in FIG. 15A that the tower 106' has been lowered a sufficient depth below the water line 52 to avoid contact with the iceberg 1270B. To effectuate this, the mooring lines 1252 have flexed at connections 1254. The arrangement of FIG. 15A shows only one connection 1254 along each line 1252; however, it is understood that the mooring lines 1252 may each have two and, perhaps, three or four, connections 1254. In one aspect, the largest link is approximately 700 meters or more.

Figure 15B:
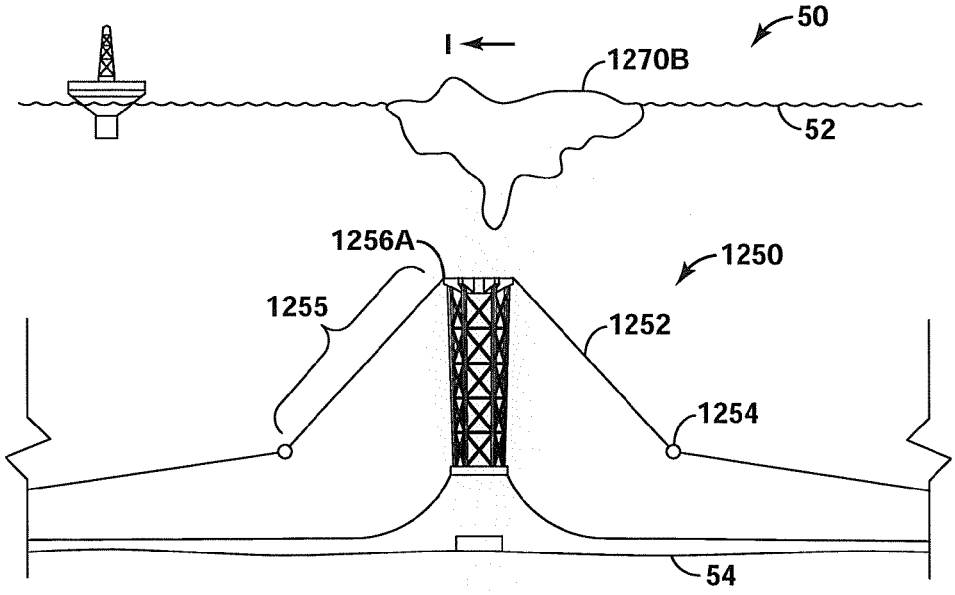
FIG. 15B shows a side view of a portion of the mooring system of FIGS. 12A and 12B. Here, the drilling structure is disconnected from the floating tower. The tower is positioned in the marine environment further to avoid contact with an extreme ice feature such as an iceberg.

FIG. 15B provides another side view of the mooring system 1250. The mooring system 1250 is connected to the tower 106'. It can also be seen in FIG. 15A that an even larger iceberg 1270B has moved in a direction "I" over the location of the drill-site. The drilling structure 120 has once again been disconnected from the drilling unit 120 and moved away from the drill-site and out of harm's way. Further, the tower 106' has been ballasted and lowered partway into the marine environment 52.

It can be seen in FIG. 15B that the tower 106' has been lowered a sufficient depth below the water line 52 to avoid contact with the iceberg 1270B. To effectuate this, the mooring lines 1252 have flexed at a connections 1254 even further than shown in FIG. 15A.

Figure 16A:
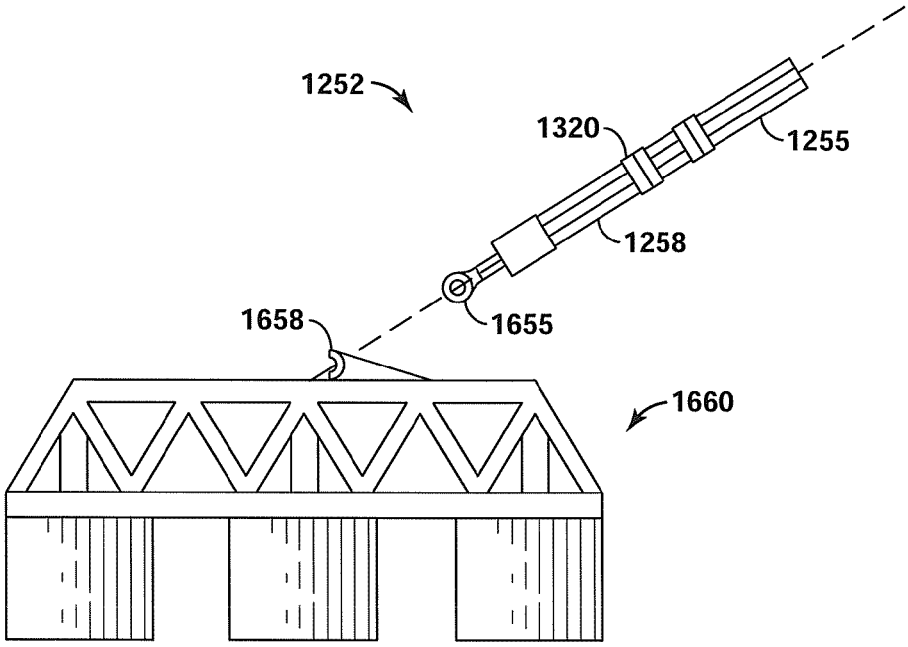
FIG. 16A is a side view of an anchor as might be used as part of a mooring system of the present inventions, in one embodiment. An end of a mooring line from FIGS. 12A and 12B is shown exploded away from a slot attached to the anchor.
Figure 16B:
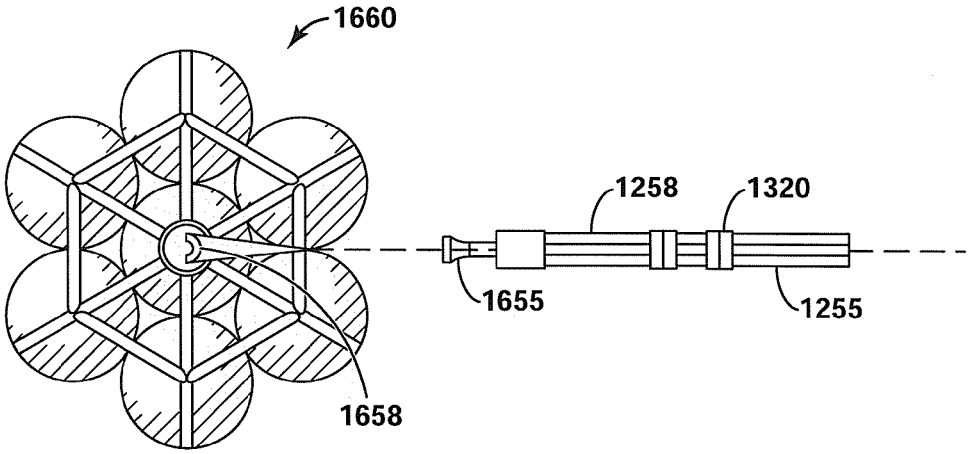
FIG. 16B is a plan view of the anchor of FIG. 16A. The end of the mooring line from FIGS. 15A and 15B is again shown exploded away from the slot attached to the anchor.

FIGS. 16A and 16B demonstrate one exemplary means for connecting the second end 1258 of a mooring line 1252 to an anchor 1660. FIG. 16A provides a side view of the mooring line 1252 and anchor 1660, while FIG. 16B provides a plan view. In the illustrative arrangement, a radial connector 1655 is provided at the very end of the mooring link 1255. The radial connector 1655 fits into a slot 1658 attached to the anchor 1660. The slot 1658 allows the radial connector 1655 and the attached substantially rigid link 1255 to pivot.

FIG. 17 demonstrates one method for connecting the first end 1256A or 1256B of a mooring line 1252 to the tower 106'. FIG. 17 provides a side view of an enlarged portion of the tower 106' at the upper end 103. In the illustrative arrangement, a radial connector 1755 is provided at the very end of the mooring link 1255. The radial connector 1755 fits into one of two slots 1758A or 1758B attached to the tower 106'. The slots 1758A or 1758B allow the radial connector 1755 and the attached substantially rigid link 1255 to pivot.

It is noted that slot 1758A is higher along the upper end 103 of the tower 106' than slot 1758B. Placement of the radial connector 1755 into slot 1758A will pull the drilling unit 100 lower into the marine environment 50 in accordance with FIG. 12A. Placement of the radial connector 1755 into slot 1758B will allow the drilling unit 100 to rise a bit higher in the marine environment 50 in accordance with FIG. 12B.

The use of substantially rigid links comprising eyebars or tendons or other metallic members connected together to form a mooring line, combined with the use of anchors along the seabed, offers a considerably increased mooring capacity, that is, an improved ability to maintain station-keeping and to resist high ice loads. The capacity is increased an order of magnitude over conventional mooring systems by replacing the known wire-rope based mooring lines with ones based on substantially rigid structural elements. Multiple eyebars or tubular members can be aligned within a single link to increase capacity as needed. Stated another way, increasing the number and/or size of eyebars or tubular members or other elongated metallic members within each link, the station-keeping capacity of each mooring line may be selectively increased. Moreover, a limited number of the mooring lines may be employed to create tremendous station-keeping capacity, e.g., at least about 100 Mega-Newtons. Such capacity could not be achieved with known wire-based mooring lines or chains, as such a large number of lines or chains would be required that the mooring system would be impractically heavy and difficult to install. Beneficially, the rigid metallic members will be easier to install and can be installed in a shorter time. This is advantageous in the arctic regions where the open water construction season is limited by icy conditions.

One requirement of a mooring system beyond capacity is to keep the floating drilling unit stable during operation, that is, to maintain the drilling unit upright with respect to tilting. The tilt (sometimes referred to as "roll" or "pitch" or "trim") of a vessel should be maintained within a given tolerance to allow drilling operations to occur. The tolerance is typically about 2 degrees of tilt. The tower (such as tower 106 or 106') does provide a long "lever" to resist the overturning tendency caused by ice loading. This overturning stems from the fact that the ice loading is applied near the waterline. However, the primary mooring lines (such as lines 1250) are located some depth below the waterline 52 to keep them out of harm's way of the ice. Those of ordinary skill in the art will understand that there are several ways to keep the tower within vertical tolerance. One approach is to use a "secondary" mooring system such as lines 170 of FIG. 1.

FIG. 10 presents a pair of illustrative thrusters 1020 at the bottom of the tower 106'. The thrusters 1020 represent an active or dynamic positioning system using sensors and computer-controlled propellers. The presence of thrusters 1020 provides thruster-assisted mooring.

The thrusters 1020 represent azimuth thrusters. An azimuth thruster is one or more ship propellers placed in pods that can be rotated in any horizontal direction. The operation of thrusters makes a rudder unnecessary. Azimuth thrusters give ships and other vessels better maneuverability than a fixed propeller and rudder system. Further, vessels with azimuth thrusters generally do not need tugs to dock, though they may still require tugs to maneuver in difficult places.

Second, mooring lines 1052 can act to stabilize the drilling unit 100 if positioned properly. Two illustrative mooring lines 1052 are shown in FIG. 10. The mooring lines 1052 have a plurality of links (not shown) in accordance with the embodiments of links 155 or 655, discussed above. A force vector T is shown indicating the station-keeping force being exerted by one of the mooring lines 1052.

It is understood that in an actual mooring system 150, more than two mooring lines 1052 would in all likelihood be employed. Two or more of the mooring lines 1052 would share the counter-acting load "T." In that instance, counter-acting loads would be divided as "T1," "T2," and so on. However, for illustrative purposes only a single mooring line 1052 is showing bearing the counter-acting load "T." The counter-acting load "T" is broken down into a horizontal force $T_H$ and a vertical force $T_v$. If the distance between the connection of the mooring lines is sufficiently wide (i.e., the distance $D_C$), then the vertical component $T_v$ can act as a counter-acting load to resist overturning.

Another way to counter-act the tilting load "T" is to use a secondary set of mooring lines. Such secondary mooring lines are presented at 170 in FIG. 1. The secondary mooring lines require less capacity than the primary rigid lines and, thus, may possibly be fabricated in accordance with traditional wire rope, polyester line systems.

Finally, the thrusters 1020 provide a dynamic force "R" to help keep the floating structure representing the drilling unit 100 upright. The force "R" provided by the thrusters 1020 is a horizontal force that is applied in the same direction as the horizontal force $F_H$ of the ice sheet 1010. This horizontal force "R" at the bottom of the tower 106 provides a direct means to maintain verticality of the tower 106. The thrusters 1020 thus become part of the mooring system 150" of FIG. 10.

As can be seen, the arctic floating drilling unit 100, in conjunction with the mooring systems in their various embodiments described herein, has the capacity to maintain station continuously, or with minimal interruption, even in high arctic ice conditions on a year-round basis. The mooring systems are able to do so without threat of interference from ice sheets. In this respect, the mooring lines are preferably connected to the tower below a depth where ice sheets will float. However, the mooring system is collapsible in the event the operator wishes to disconnect the drilling structure from the tower and lower the tower into the water to avoid an iceberg or for other purposes.

The mooring systems herein are also compatible with known systems for protecting the drilling riser (not shown) from ice. Protection of the drilling riser may be provided by enclosing the hull of the drilling structure in the vicinity of the ice loads. An example is shown in U.S. Pat. No. 4,434,741 issued in 1984 and entitled "Arctic Barge Drilling Unit." Of course, the present mooring systems are not limited to the configuration of a floating vessel.

The station-keeping function of the mooring systems herein may be optimized by adjusting the angles of selected individual mooring lines relative to the sea surface and by adjusting the dimensions of the tower 106'. The angles of the mooring lines and the dimensions of the tower 106' may be optimized to resist the range of effective angles of the ice loads anticipated to be applied by ice sheets while minimizing the loads within the mooring lines. In one aspect, an angle $\theta_T$ of about 30 degrees in combination with tower dimensions of 200 meters in length and 70 meters in width is sufficient to accomplish this objective. Those of ordinary skill in the art will understand that the actual design parameters will vary with each application.

Interestingly, tuning the angle of a mooring line may allow the "leeward" line, that is, the line opposite the mooring line under highest load, to maintain roughly a zero change in tension. This prevents the leeward line from going into compression and, possibly, inducing some undesirable motions into the drilling unit.

An issue arises in connection with the use of rigid links in a mooring line. That issue is that the rigidity of the links tends to make the entire line relatively rigid as well. This, in turn, means that a degree of precision is needed when radially spacing the anchors (such as anchors 160) around the tower 106'.

In known wire rope mooring systems, the ability to add or reduce line length is easily accomplished by spooling or winching the line. This reduces the need for precision in the placement of anchors. However, for the mooring systems described herein, the length of the mooring line is not easily adjusted with on-board equipment due to the high capacity requirements of the equipment and the requirement to separate the drilling structure 120 under threat of ice sheets. In addition, it is difficult to place anchors within a high degree of tolerance, e.g., a few centimeters. Therefore, adjustment for installation tolerances in the mooring system is desirable.

In one aspect, different connection points 158 may be provided along the anchors 160. However, even this may not be fine enough for subsea installation tolerances. As an alternative, a central positioning template may be employed during installation as a guide for the placement of the various anchors.

Figure 11A:
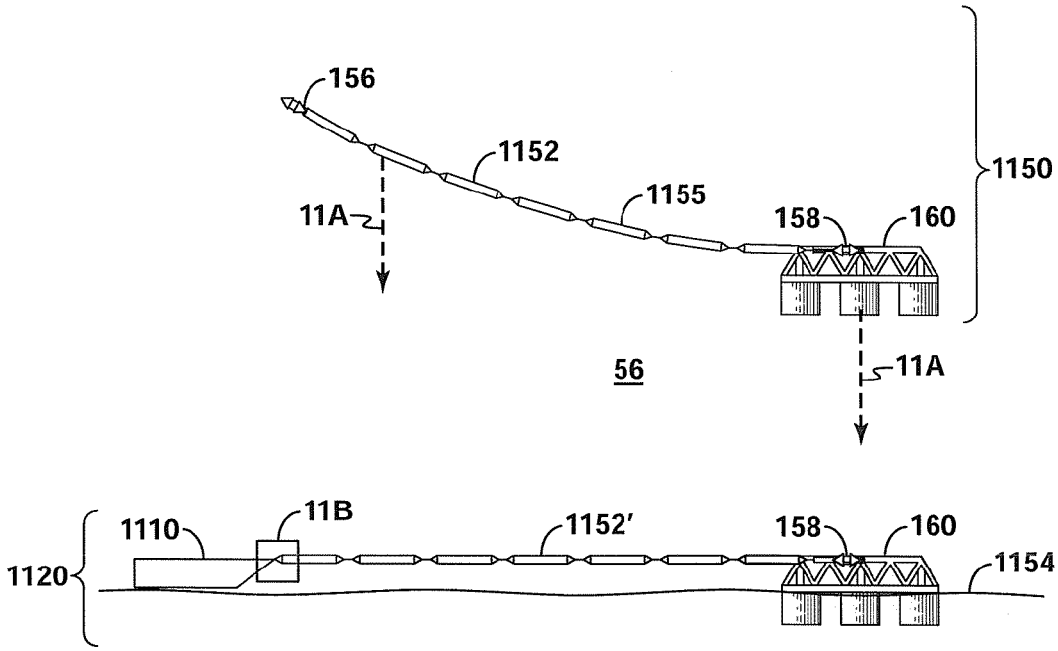
FIG. 11A is a side view of a line used to space an anchor apart from a template. The spacing line may be a segment of a permanent mooring line, or may be a separate, temporary line.

FIG. 11A demonstrates a schematic for deploying a mooring system 1150 for a floating structure. The floating structure may be, for example, the drilling unit 100 of FIG. 1. The method meets the need to install substantially rigid mooring lines and corresponding anchors within acceptable tolerances quickly and with minimal support equipment.

It can be seen in FIG. 11A that a mooring line 1152 and corresponding anchor 1160 are placed within a marine environment 56, that is, offshore and under water. The mooring line 1152 comprises a plurality of substantially rigid links 1155 connected together using pivoting connections, such as pins. The links 1155 in the mooring line 1152 may comprise at least two eyebars, or may comprise a plurality of substantially hollow tubular members. The mooring line 1152 is preferably capable of withstanding at least about ten Mega-Newtons of force, and more preferably up to about 100 Mega-Newtons of force. More preferably, the mooring line 1152 is capable of withstanding up to about 500 Mega-Newtons of force.

The mooring line 1152 has a first end 156 configured to be operatively connected to a caisson (not shown), and a second end 158 operatively connected to the anchor 160. Each of the first 156 and second 158 ends includes a pivoting connector, such as connector 158 of FIG. 5C. The mooring line 1152, the anchor 160 and the connectors make up a mooring system 1150, indicated by a bracket. Selected links within the mooring line 1152 may receive material that increases buoyancy.

A seabed 1154 is also seen as part of the marine environment 56. In FIG. 11A, the mooring system 1150 is shown suspended above the seabed 1154. Arrows 11A demonstrate lowering of the mooring system 1150 onto the seabed 1154. Once in place, the permanent mooring lines 1152 will extend from the seabed 1154 up to a tower. More specifically, the anchor 160 will be attached to the seabed 1154, and the permanent mooring line 1152 will extend up from the anchor 160 and attach to the tower.

In order to secure the anchor 160 at the correct position relative to the tower, a positioning template 1110 is employed. The positioning template 1110 is preferably a heavy steel skid configured to rest on the seabed 1154. The positioning template 1110 may be a modified version of a drilling template normally installed along the seabed 1154 and through which wells are drilled. In connection with the method for deploying a mooring system 1150, the template 1110 is placed on the seabed 1154. This is shown at bracket 1120. The positioning template 1110 is placed along the seabed 1154 at a position below where the tower will later be deployed for operation.

Next, a setting line 1152' is lowered into the marine environment 56. This setting line 1152' is also indicated at bracket 1120. The setting line 1152' may be a portion of mooring line 1152 having a predetermined length. Alternatively, the setting line 1152' may be a temporary measuring line. Either way, the setting line 1152' is attached to the anchor 160 at end 158 of the anchor 160. However, the anchor 160 is not yet attached to the seabed 1154.

The setting line 1152' is next connected to the positioning template 1110. To accommodate this step, a guide bracket 1112 is provided along the positioning template 1110. The guide bracket 1112 is shown at an end of the template 1110 in FIG. 11B.

Figure 11B:
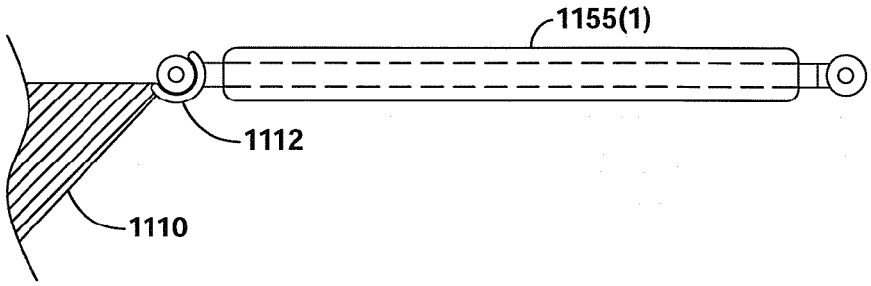
FIG. 11B is an enlarged side view of the spacing line of FIG. 11A. The connection between the temporary mooring line and the template is shown.

FIG. 11B presents an expanded view of a portion of bracket 1120 of FIG. 11A. The expanded area is indicated in FIG. 11A at 11B. Referring to FIG. 11B, a side view of the guide bracket 1112 and of the positioning template 1110 is provided. The guide bracket 1112 provides a pivoting connection between the template 1110 and the setting line 1152'. A first joint 1155(1) of the setting line 1152' is shown connected to the guide bracket 1112.

The length of the setting line 1152' to the first joint 1155(1) is dimensioned to provide an accurate spacing between the template 1110 and the anchor 1160. Taking advantage of the rigid nature of the setting line 1152', the anchor 1160 is completely lowered in the marine environment 56 to the seabed 1154 at the appropriate distance from the positioning template 1110. The anchor 1160 is secured to the seabed 1154 either gravitationally or by means of pile or suction attachments.

The above process for positioning an anchor 1160 is repeated using the setting line 1152'. In this respect, the setting line 1152' is disconnected from each anchor 1160 as it is placed on the seabed 1154. Multiple anchors 1160 are thereby properly positioned for future connection to the tower. The positioning template 1110 may then be removed and, optionally, transported away.

Once the anchors 1160 are secured to the seabed 1154, a tower such as tower 106' is brought on-site. The tower is brought into an upright position. Mooring lines 1152 may then be connected between the tower and the respective anchors 1160. The positioning template 1110 allowed the anchors 1160 to be placed with a high degree of accuracy so that the mooring lines 1152 readily connect to the tower.

Once the tower is fully connected, the operator increases the draft of the tower. The drilling structure is then floated over the tower and connected. The tower may be partially de-ballasted to achieve a desired pre-tension in the mooring lines 1152.

Figure 11C:
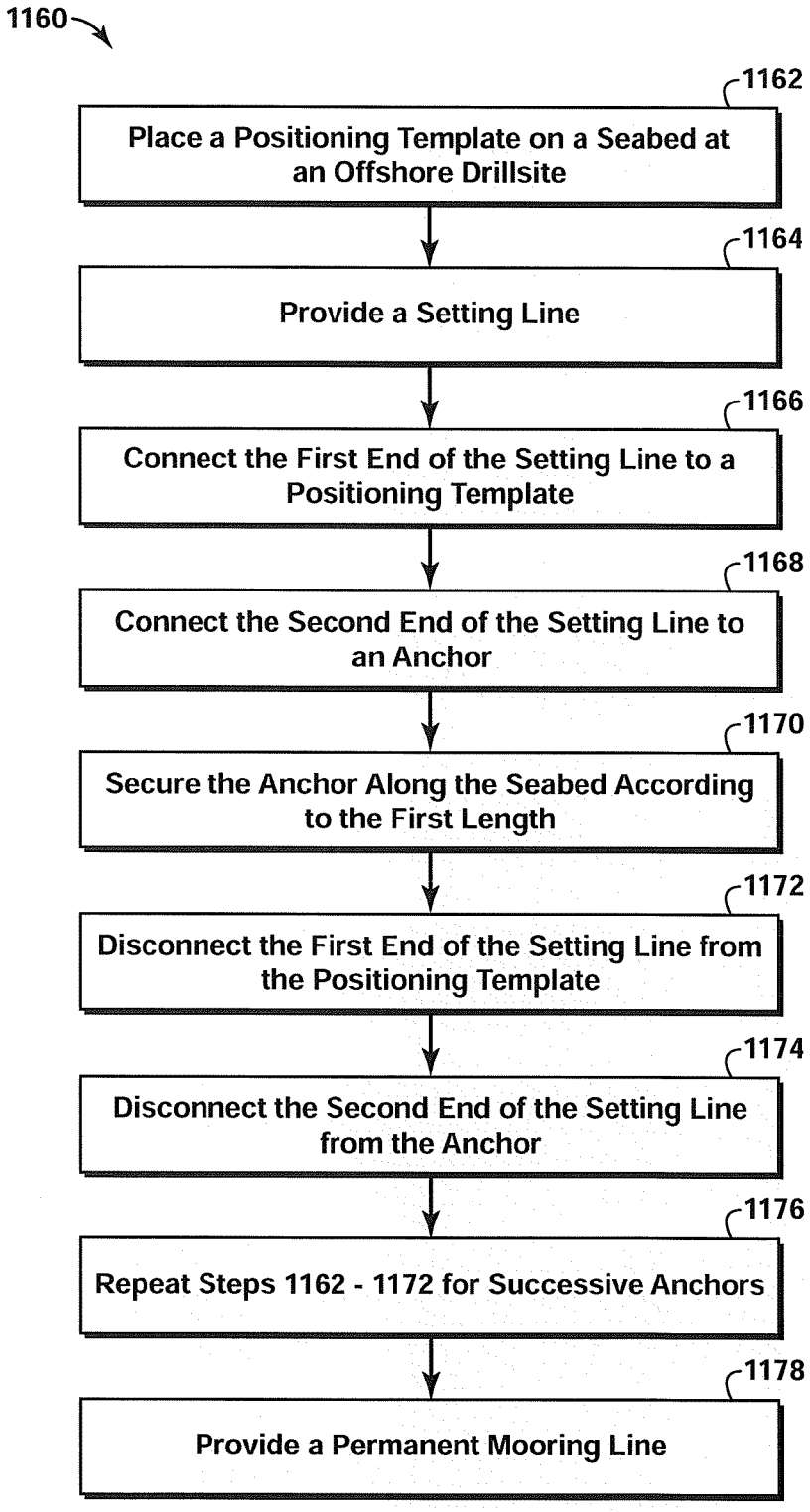
FIGS. 11C and 11D together provide a unified flow chart for a method for deploying a mooring system for a floating structure.
Figure 11D:
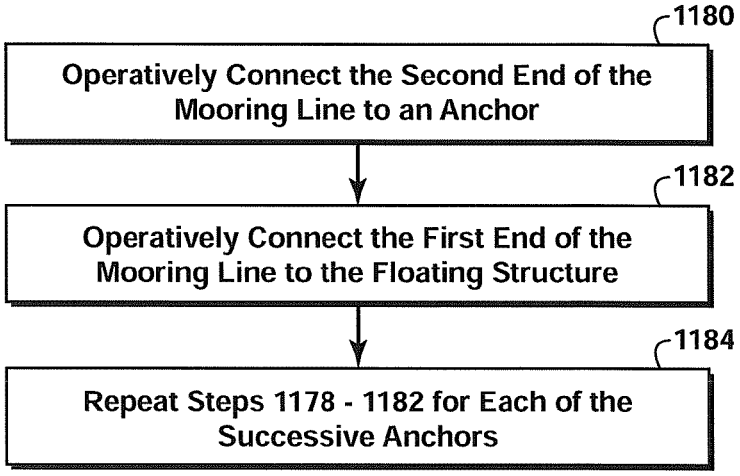

FIGS. 11C and 11D together provide a unified flow chart for a method 1160 for deploying a mooring system for a floating structure. The mooring system may be in accordance with mooring system 1150 of FIG. 11A or mooring system 1250 of FIG. 12A. The floating structure may be, for example, the drilling unit 100 of FIG. 12A. In this respect, the floating structure generally includes a platform on which operations are performed in a marine environment. The floating structure also includes a tower for providing ballast and stability below a water line in the marine environment.

The method 1160 includes placing a positioning template on a seabed at an offshore work site, such as a drill site. This is shown at Box 1162 of FIG. 11C. The positioning template is placed below the intended location of the tower at the drill site. The method 1160 also includes providing a setting line. This is indicated at Box 1162. The setting line has a first end, a second end, and a plurality of substantially rigid links joined together using linkages. Each link comprises at least one elongated, metallic member.

The method 1160 also includes connecting the first end of the setting line to the positioning template, and then connecting the second end of the setting line to an anchor. These steps are provided in Boxes 1166 and 1168, respectively. The anchor is used to secure the setting line and, later, a mooring line as connected to the floating structure.

The method 1160 also includes securing the anchor along the seabed. This is presented in Box 1170. The manner of securing is dictated by the type of anchor employed. For example, if the anchor just has a block base, the anchor may be gravitationally secured by just setting the anchor onto the seabed. If the anchor employs suction piles, then the anchor is secured by removing soil below the seabed and countersinking the suction pile. The anchor is secured according to the first length.

The method 1160 further includes disconnecting the first end of the setting line from the positioning template, and disconnecting the second end of the setting line from the anchor. These steps are provided in Box 1172 and 1174, respectively. In this way, the setting line is free. It is noted here that the setting line may be a temporary measuring line used for properly spacing the anchor from the template. Alternatively, the setting line may be a portion of a permanent mooring line having a predetermined length. In either instance, the steps 1164 through 1174 are repeated for successive anchors so as to properly space a plurality of anchors around the positioning template. The process of repeating the steps is shown at Box 1176.

The method 1160 also comprises providing a permanent mooring line. This is shown at Box 1178. The mooring line has a first end, a second end, and a plurality of substantially rigid links joined together using linkages. The mooring line may be, for example, in accordance with line 150 of FIG. 1, line 1152 of FIG. 11A, or line 1250 of FIG. 12A.

The method 1160 also includes operatively connecting the second end of the mooring line to a respective anchor. This is shown at Box 1180 of FIG. 11D. The method 1160 further includes operatively connecting the first end of the mooring line to the floating structure. This step is provided in Box 1182. Preferably, the respective first ends are connected to the floating structure at a top portion of the tower.

Steps 1178 through 1182 are then repeated for each of the successive anchors. Preferably, each permanent mooring line that is installed is capable of withstanding at least about 100 Mega-Newtons of force from a moving ice sheet. In one aspect, the force from the moving ice sheet has a horizontal component, and each mooring line is capable of withstanding at least about 500 Mega-Newtons of horizontal force.

The inventions described herein are not restricted to offshore structures used to support drilling rigs. The inventions are suitable for any type of offshore vessel operating in arctic waters in which there is a need for protection against dynamic masses of ice. Examples include production support, arctic research vessels, and strategic locations for military or civilian logistics support in arctic waters.

While it will be apparent that the inventions herein described are well calculated to achieve the benefits and advantages set forth above, it will be appreciated that the inventions are susceptible to modification, variation and change without departing from the spirit thereof. Improvements to maintaining a floating vessel "on location" in the presence of heavy ice conditions typical of the "high arctic" are offered.

What is claimed is:

1. A mooring system for a floating vessel, the floating vessel having a platform for conducting operations in a marine environment, and a floating tower for providing ballast and stability below a water line in the marine environment, the mooring system comprising:

a plurality of anchors disposed around the tower along a seabed; and a plurality of mooring lines, each mooring line having a first end operatively connected to the tower and a second end operatively connected to a respective anchor, each mooring line comprising at least two substantially rigid links joined together using pivoting connections such that the pivoting connections provide relative motion between adjoining links along a single plane.

2. The mooring system of claim 1, wherein each link is at least five meters in length.

3. The mooring system of claim 1, wherein the mooring system has the capacity to maintain station-keeping for the vessel in the presence of ice forces greater than about 100 Mega-Newtons.

4. The mooring system of claim 1, wherein:

the ice forces have a horizontal component; and each mooring line is capable of withstanding at least about 500 Mega-Newtons of horizontal force.

5. The mooring system of claim 1, wherein the floating vessel has an axi-symmetric shape.

6. The mooring system of claim 1, wherein:

the floating vessel is a floating drilling unit; and the operations are offshore drilling operations or production operations.

7. The mooring system of claim 6, wherein each of the plurality of anchors comprises a weighted block held on the seabed by gravity, or a frame structure with a plurality of pile-driven pillars or suction pillars secured to the earth proximate the seabed.

8. The mooring system of claim 6, wherein:

each link comprises a plurality of elongated members disposed parallel to one another.

9. The mooring system of claim 8, wherein the plurality of elongated members comprise either two or more eyebars or two or more substantially hollow tubular members.

10. The mooring system of claim 6, wherein:

the first end of each of the plurality of mooring lines is connected to the tower proximate an upper end of the tower; and each of the first ends is selectively connectable to the tower at two or more different depths along the upper end of the tower so as to adjust the floating position of the drilling unit within the marine environment.

11. The mooring system of claim 10, wherein the first end of each of the plurality of mooring lines is connected to the tower by means of a selectively pivoting link having a first end pinned to the tower at a first point, and a second end which is selectively:

pinned to the tower at a second lower point to increase draft of the floating vessel, and not pinned to the tower at the second lower point to decrease draft of the floating vessel, depending on the marine conditions.

12. The mooring system of claim 10, wherein:

the first end of each of the plurality of mooring lines is connected to the caisson by means of a radial connector that lands in a slot to permit pivoting motion for the respective mooring lines to the tower; and a first slot is provided at each of the two or more different depths along the upper end of the caisson.

13. The mooring system of claim 6, wherein each of the plurality of anchors comprises a plurality of connection points for selectively connecting each respective mooring line along a corresponding anchor, thereby adjusting the distance of the caisson from the connection point.

14. The mooring system of claim 6, wherein:

the platform is supported by a drilling hull having a frustoconical shape; and the drilling unit further comprises a neck connecting the drilling structure to the caisson.

15. The mooring system of claim 6, further comprising:

a plurality of secondary mooring lines, each line having a first end connected to the caisson proximate a bottom end of the caisson, and a second end connected to a respective anchor.

16. The mooring system of claim 15, wherein each of the secondary mooring lines is fabricated from chains, wire ropes, synthetic ropes or pipes.

17. The mooring system of claim 6, further comprising:

a template adapted to temporarily receive the first end of each of a plurality of setting lines, each setting line having a predetermined length such that the template may be placed on the seabed directly under the tower, and each of the anchors may be positioned around the template at a proper radius.

18. The mooring system of claim 17, wherein the setting line is either a portion of a mooring line having a predetermined length or a temporary measuring line.

19. The mooring system of claim 6, wherein selected links within each of the plurality of mooring lines receives material that increases buoyancy.

20. The mooring system of claim 19, wherein the selected joints comprise syntactic foam to increase buoyancy.

21. The mooring system of claim 19, wherein the selected joints comprise a material to increase buoyancy, which is wrapped around the selected links or attached to the selected links.

22. The mooring system of claim 6, further comprising:

at least one thruster placed proximate a bottom of the tower adapted to further provide ballast and stability of the tower below the water line.

23. The mooring system of claim 6, wherein:

each of the plurality of mooring lines is connected between the tower and the anchor in a state of substantial tension; and an angle of at least two of the plurality of mooring lines relative to the water line is selected to reduce movement of the drilling unit, wherein the angle is selected by considering the dimensions of the tower and the distance of the mooring lines from the anchor to the tower.

24. A method for deploying a mooring system for a floating structure, comprising:

(A) placing a positioning template on a seabed at an offshore work site;

(B) providing a setting line, the setting line having a first end, a second end, and a plurality of substantially rigid links joined together using linkages, each link comprising at least one elongated, metallic member;

(C) connecting the first end of the setting line to the positioning template;

(D) connecting the second end of the setting line to an anchor;

(E) securing the anchor along the seabed according to the first length;

(F) disconnecting the first end of the setting line from the positioning template and the second end of the setting line from the anchor;

(G) repeating steps (A) through (F) for successive anchors such that a plurality of anchors is placed around the positioning template;

(H) providing a permanent mooring line, the mooring line having a first end, a second end, and a plurality of substantially rigid links joined together using linkages;

(I) operatively connecting the second end of the mooring line to an anchor;

(J) operatively connecting, a first end of the mooring line to the floating structure; and (K) repeating steps (H) through (J) for each of the successive anchors.

25. The method of claim 24, wherein:

the floating structure is a floating drilling unit comprising:

a platform for providing drilling operations in a marine environment, and a tower adapted to provide ballast and stability below a water line in the marine environment;

the work site is a drill site where drilling and production operations take place;

the positioning template is placed below the intended location of the tower at the drill-site; and the first end of each of the respective permanent mooring lines is operatively connected to the tower.

26. The method of claim 25, wherein each of the anchors comprises either a weighted block held on the seabed by gravity, or a frame structure with pile-driven pillars or suction pillars secured to the earth proximate the seabed.

27. The method of claim 25, wherein:

each link comprises a plurality of elongated metallic members disposed parallel to one another; and the links are joined together using a pivoting connector.

28. The method of claim 27, wherein the plurality of elongated metallic members comprise either two or more eyebars or two or more substantially hollow tubular members.

29. The method of claim 28, wherein:

the first end of each of the plurality of mooring lines is connected to the tower proximate an upper end of the tower; and each of the first ends is selectively connectable to the tower at two or more different depths along the upper end of the tower so as to adjust the floating height of the floating drilling unit.

30. The method of claim 25, wherein each permanent mooring line is capable of withstanding at least about 100 Mega-Newtons of force from a moving ice sheet.

31. The method of claim 30, wherein:

the force from the moving ice sheet has a horizontal component; and each permanent mooring line is capable of withstanding at least about 500 Mega-Newtons of horizontal force.

32. The method of claim 25, wherein selected links within each of the plurality of permanent mooring lines receives material that increases buoyancy.

33. A method for relocating a floating structure, the floating structure comprising a platform for providing operations in a marine environment and a tower for providing ballast and stability below a water line in the marine environment, the method comprising:

disconnecting the tower from the platform;

lowering the tower within the marine environment to a depth below the depth of an oncoming ice sheet; and moving the floating structure to a new location in the marine environment;

wherein the floating structure is originally stationed in the arctic marine environment by means of a mooring system, the mooring system comprising:

a plurality of mooring lines having a first end operatively connected to the tower and a second end, with each mooring line comprising at least two substantially rigid links joined together using pivoting connections that permit the mooring lines to kinematically collapse as the tower is lowered into the marine environment, and a plurality of anchors placed along the seabed, each anchor securing a respective mooring line at the second end of the mooring line.

34. The method of claim 33, wherein:

the floating structure is an offshore drilling unit comprising a drilling structure and the tower;

the platform provides drilling operations in the marine environment; and the operations are drilling or production operations.

35. The method of claim 34, wherein selected links within each of the plurality of mooring lines receives a material that increases buoyancy such that mooring lines more easily kinematically collapse to accommodate the reduced distance from the respective anchors to the tower as the tower is lowered to the seabed.

36. The method of claim 34, wherein:

each of the plurality of links is at least about thirty meters in length; and each of the mooring lines comprises no more than three linkages.

37. The method of claim 34, wherein each of the plurality of anchors comprises either a weighted block held on the seabed by gravity, or a frame structure with pile-driven pillars or suction pillars secured to the earth proximate the seabed.

38. The method of claim 34, wherein:

each joint comprises either at least one eyebar, or a plurality of elongated, substantially hollow tubular members.

39. The method of claim 34, wherein the links are joined using pins.

40. The method of claim 34, wherein each mooring line is capable of withstanding at least about 100 Mega-Newtons of force from a moving ice sheet.

41. The method of claim 40, wherein:

the force from the moving ice sheet has a horizontal component; and each permanent mooring line is capable of withstanding at least about 500 Mega-Newtons of horizontal force.

* * * * *